US010399356B2

(12) United States Patent
Moriyama et al.

(10) Patent No.: US 10,399,356 B2
(45) Date of Patent: Sep. 3, 2019

(54) LIQUID EJECTING APPARATUS

(71) Applicant: SEIKO EPSON CORPORATION, Tokyo (JP)

(72) Inventors: Ryuji Moriyama, Matsumoto (JP); Makoto Sato, Matsumoto (JP); Hisayuki Akahane, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/787,179

(22) Filed: Oct. 18, 2017

(65) Prior Publication Data

US 2018/0117927 A1 May 3, 2018

(30) Foreign Application Priority Data

Oct. 27, 2016 (JP) ..... 2016-210308

(51) Int. Cl.

| | |
|---|---|
| ***B41J 2/21*** | (2006.01) |
| ***B41J 2/15*** | (2006.01) |
| ***B41J 29/02*** | (2006.01) |
| ***B41J 2/17*** | (2006.01) |
| ***B41J 2/175*** | (2006.01) |
| ***B41J 2/185*** | (2006.01) |
| ***B41J 2/165*** | (2006.01) |

(Continued)

(52) U.S. Cl.

CPC ..... *B41J 2/2103* (2013.01); *B41J 2/15* (2013.01); *B41J 2/1652* (2013.01); *B41J 2/16508* (2013.01); *B41J 2/16523* (2013.01); *B41J 2/1721* (2013.01); *B41J 2/1752* (2013.01); *B41J 2/17509* (2013.01); *B41J 2/17553* (2013.01); *B41J 2/17566* (2013.01); *B41J 2/17596* (2013.01); *B41J 2/185* (2013.01); *B41J 29/02* (2013.01); *B41J 29/13* (2013.01); *B41J 29/38* (2013.01); *B41J 2002/16594* (2013.01); *B41J 2002/1856* (2013.01)

(58) Field of Classification Search

CPC ..... B41J 29/02

See application file for complete search history.

(56) References Cited

U.S. PATENT DOCUMENTS 5,325,111 A * 6/1994 Dietl ..... B41J 2/16523 347/30

5,907,343 A * 5/1999 Takemura ..... B41J 2/1652 346/145

(Continued)

FOREIGN PATENT DOCUMENTS

JP 2014-079908 A 5/2014

*Primary Examiner* — Shelby L Fidler

(74) *Attorney, Agent, or Firm* — Workman Nydegger

(57) ABSTRACT

A liquid ejecting apparatus includes: a liquid ejecting section having a nozzle that is configured to eject liquid; a liquid tank that is configured to receive the liquid ejected from the nozzle, and is disposed at a separate position from the liquid ejecting section; a waste liquid containing chamber that stores liquid ejected from the liquid ejecting section or waste liquid generated during a maintenance operation of the liquid ejecting section; a main base section which includes at least the liquid ejecting section and constitutes a base of the apparatus; and a sub base section which includes at least one of the liquid tank and the waste liquid containing chamber and is detachably attached to the main base section, and constitutes a base of the apparatus together with the main base section.

9 Claims, 31 Drawing Sheets

(51) Int. Cl.
*B41J 29/13* (2006.01)
*B41J 29/38* (2006.01)

(56) References Cited

U.S. PATENT DOCUMENTS

| | | | | |
|---|---|---|---|---|
| 2002/0118242 | A1* | 8/2002 | Tajima | B41J 2/17556<br>347/17 |
| 2012/0218348 | A1* | 8/2012 | Okamoto | B41J 2/16508<br>347/36 |
| 2014/0104349 | A1 | 4/2014 | Kimura et al. | |
| 2015/0124028 | A1 | 5/2015 | Kimura et al. | |
| 2015/0138283 | A1* | 5/2015 | Kanaya | B41J 2/175<br>347/85 |
| 2015/0283816 | A1 | 10/2015 | Kimura et al. | |
| 2016/0200111 | A1 | 7/2016 | Kimura et al. | |
| 2017/0282568 | A1* | 10/2017 | Osakabe | B41J 2/16535 |
| 2018/0126743 | A1* | 5/2018 | Moriyama | B41J 2/1721 |

* cited by examiner

LIQUID EJECTING APPARATUS

BACKGROUND

1. Technical Field

The present invention relates to liquid ejecting apparatuses that eject liquid.

2. Related Art

An example of liquid ejecting apparatuses that eject liquid includes ink jet printers. Ink jet printers include a so-called serial type ink jet printer which is provided with a recording head as a liquid ejecting section that ejects ink, which is an example of liquid, as well as a carriage which is movable in a predetermined direction. Further, ink jet printers include a type in which an ink containing chamber that stores ink is mounted on a carriage, and a type in which an ink containing chamber is provided outside the carriage. In the type in which an ink containing chamber is provided outside the carriage, the ink containing chamber and the carriage (recording head) are connected to each other via an ink supply tube.

For example, JP-A-2014-79908 discloses a configuration in which an ink tank (ink containing chamber) is provided on the apparatus front side and the ink tank is covered by a cover. In this configuration, the ink tank is housed in a housing that forms the outer appearance of the entire apparatus so that the ink tank does not protrude from the apparatus side surface in favor of outer appearance design.

However, in the case of design changes by which an ink tank is added to increase an ink color (model change of the apparatus), the configuration described in JP-A-2014-79908 is required to change the entire housing design. This leads to extension of the development period and increase in the cost. Further, increase of ink color as described above is merely an example, and there are other cases such as design change from the ink tank type, which is an ink introduction type for example as described in JP-A-2014-79908 to the cartridge exchange type, or change from a type in which ink tanks or ink cartridges are provided in the apparatus main body in a fixed manner (off carriage type) to a type in which they are provided on the carriage (on carriage type). In such cases, the entire housing design needs to be changed, which also leads to extension of the development period and increase in the cost. From the above view point, there is still room for improvement for the conventional ink jet printers.

SUMMARY

An advantage of some aspects of the invention is that a liquid ejecting apparatus that takes into consideration at least either of shortening of the development period or reduction in the cost in changing the apparatus design is provided.

A liquid ejecting apparatus according to a first aspect of the present invention includes: a liquid ejecting section having a nozzle that is configured to eject liquid; a liquid tank that is configured to receive the liquid ejected from the nozzle, and is disposed at a separate position from the liquid ejecting section; a waste liquid containing chamber that stores liquid ejected from the liquid ejecting section or waste liquid generated during a maintenance operation of the liquid ejecting section; a main base section which includes at least the liquid ejecting section and constitutes a base of the apparatus; and a sub base section which includes at least one of the liquid tank and the waste liquid containing chamber and is detachably attached to the main base section, and constitutes a base of the apparatus together with the main base section.

In this aspect, the base of the apparatus is composed of the main base section as well as the sub base section, which is detachably attached to the main base section, and the sub base section includes at least one of the liquid tank and the waste liquid containing chamber. Accordingly, the apparatus design can be changed only by changing the sub base section without changing the main base section, thereby enabling at least either of shortening of the development period or reduction in the cost in changing the apparatus design.

According to this aspect, the liquid ejecting apparatus further includes: a fluid containing chamber that is connected to the liquid tank and stores liquid discharged from the liquid tank, wherein the liquid tank, the waste liquid containing chamber and the fluid containing chamber are provided in the sub base section.

In this aspect, the liquid tank, the waste liquid containing chamber and the fluid containing chamber are provided in the sub base section. Accordingly, at least either of shortening of the development period or reduction in the cost can be achieved in changing the design of at least one of the liquid tank, the waste liquid containing chamber and the fluid containing chamber. Note that, the fluid stored in the fluid containing chamber herein is not limited to the liquid discharged from the liquid tank, but also includes gas.

According to this aspect, the sub base section is detachably attached to at least one side of the main base section.

In this aspect, in the configuration in which the sub base section is detachably attached to at least one side of the main base section, the effects of the first or second aspect can be obtained.

According to this aspect, the liquid ejecting apparatus further includes: a liquid supply path member that is connected to the liquid tank and guides liquid from the liquid tank toward the liquid ejecting section; a waste liquid flow path member that is connected to the waste liquid containing chamber and guides the waste liquid to the waste liquid containing chamber; and a connection flow path member that is connected to the fluid containing chamber and guides liquid discharged from the liquid tank to the fluid containing chamber, wherein the sub base section includes a flow path holding section that includes at least one of the liquid supply path member, the waste liquid flow path member and the connection flow path member.

In this aspect, components associated with liquid are closely positioned compared with the configuration in which the liquid supply path member, the waste liquid flow path member and the connection flow path member are provided to the dedicated setting members at separate positions, thereby preventing the apparatus from increasing in size or facilitating assembly of the apparatus.

According to this aspect, the liquid ejecting apparatus further includes: a maintenance unit that performs maintenance of the liquid ejecting section, wherein the maintenance unit is disposed in the sub base section.

In this aspect, the maintenance unit is disposed in the sub base section. Accordingly, components associated with liquid are closely positioned compared with the configuration in which the maintenance unit is provided to the dedicated setting member at a separate position, thereby preventing the apparatus from increasing in size or facilitating assembly of the apparatus.

According to this aspect, at least part of the sub base section is located in a movement area of the liquid ejecting section in a movement direction of the liquid ejecting section.

In this aspect, at least part of the sub base section is located in a movement area of the liquid ejecting section in a movement direction of the liquid ejecting section. Accordingly, the apparatus size in the movement direction of the liquid ejecting section can be reduced.

According to this aspect, the liquid ejecting section is disposed on the carriage that is movable in an apparatus width direction, and the liquid tank is disposed on one end of the movement area of the carriage, and includes: a first structure; and a second structure that is disposed on the first structure and has a projected area in a planar direction which is smaller than the projected area of the first structure, wherein when the carriage is located on one end of the movement area, at least part of the first structure overlaps at least part of the carriage in the apparatus depth direction, and at least part of the second structure overlaps at least part of the carriage in the apparatus width direction.

In this aspect, when the carriage is located on one end of the movement area, at least part of the first structure overlaps at least part of the carriage in the apparatus depth direction. Accordingly, the size in the apparatus depth direction can be reduced. Further, at least part of the second structure overlaps at least part of the carriage in the apparatus width direction. Accordingly, the size in the apparatus width direction can be reduced.

According to this aspect, the first structure has at least two surfaces of peripheral surfaces that is covered by a wall of the sub base section, and a top surface that is reinforced by a reinforcement member. In this aspect, the strength of the first structure can be improved.

According to this aspect, the liquid supply path member extends upward from a connecting section of the liquid tank, and is then bent into a movement direction of the liquid ejecting section, and a portion of the liquid supply path member which extends upward is located in the movement area of the carriage having the liquid ejecting section in a movement direction of the liquid ejecting section.

In this aspect, a portion of the liquid supply path member which extends upward is located in the movement area of the carriage having the liquid ejecting section in a movement direction of the liquid ejecting section. Accordingly, the apparatus size in the movement direction of the liquid ejecting section can be reduced.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
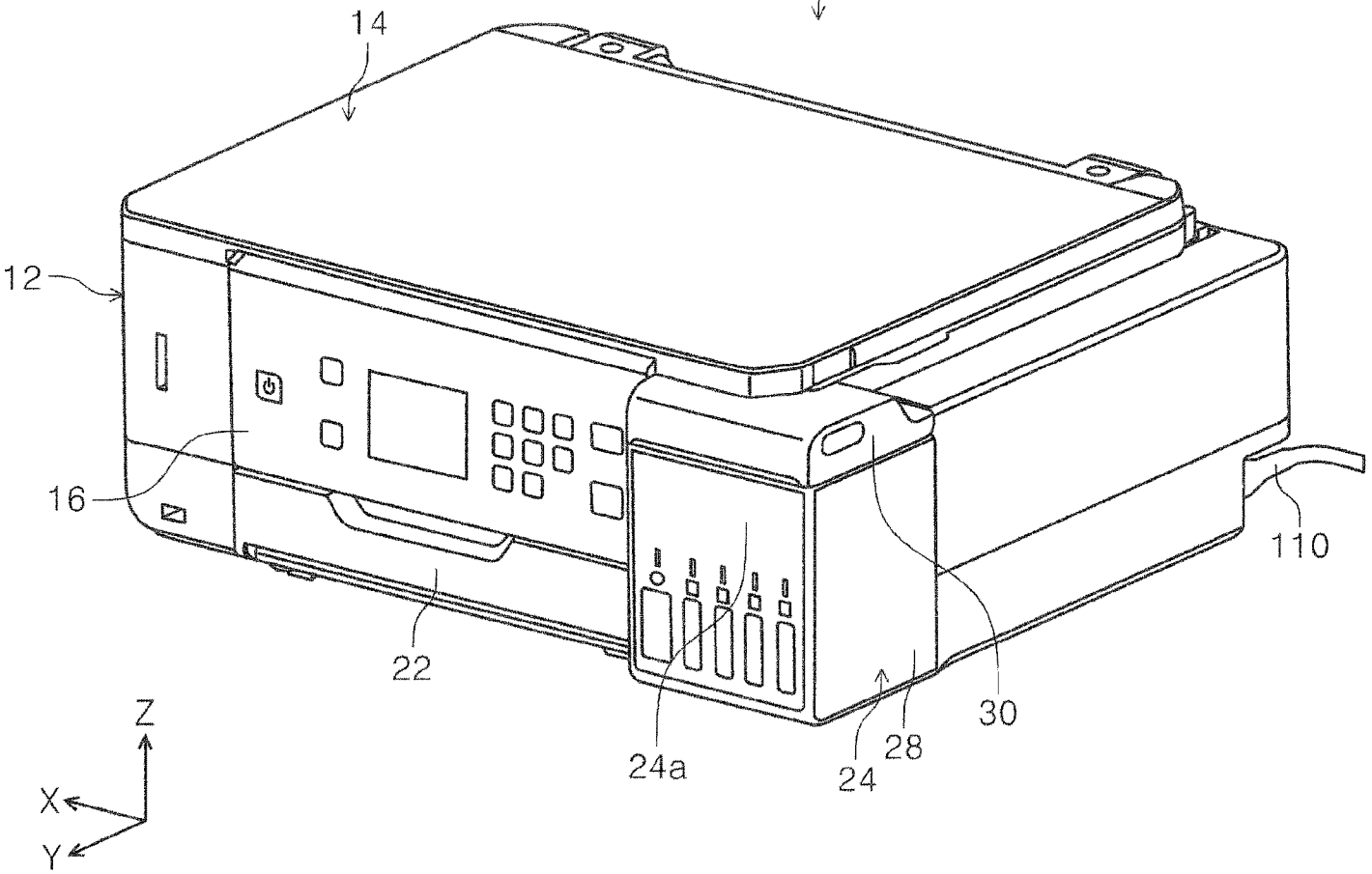
FIG. 1 is an outer appearance perspective view of a printer according to the present invention.

With reference to the drawings, an embodiment of the present invention will be described. Throughout the embodiments, the same components are denoted by the same reference numerals and the description thereof is made only in the embodiment in which the component first appears to avoid duplication of description in the subsequent embodiments.

Figure 2:
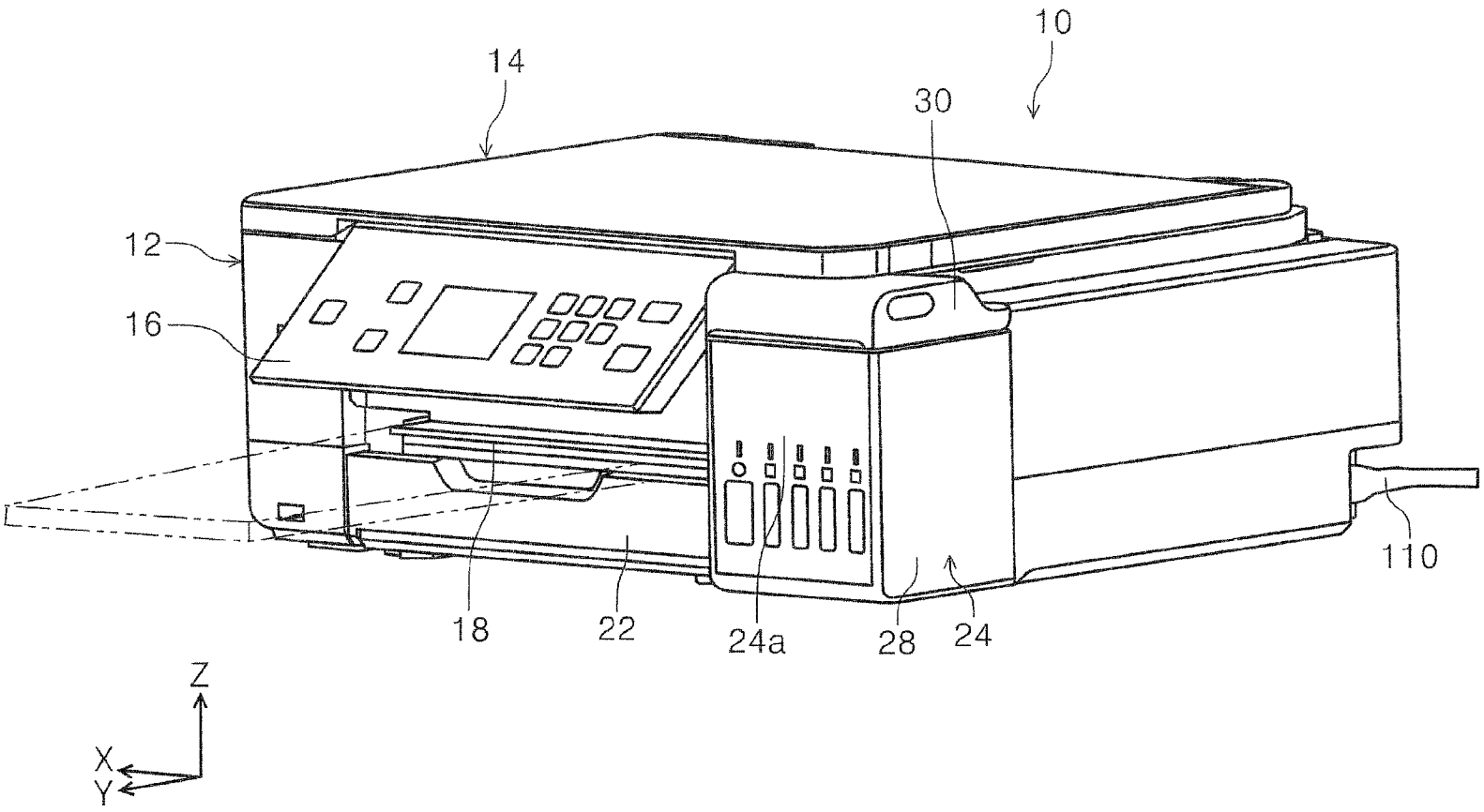
FIG. 2 is an outer appearance perspective view of the printer in a state where an operation section has been rotated forward in an apparatus depth direction.
Figure 3:
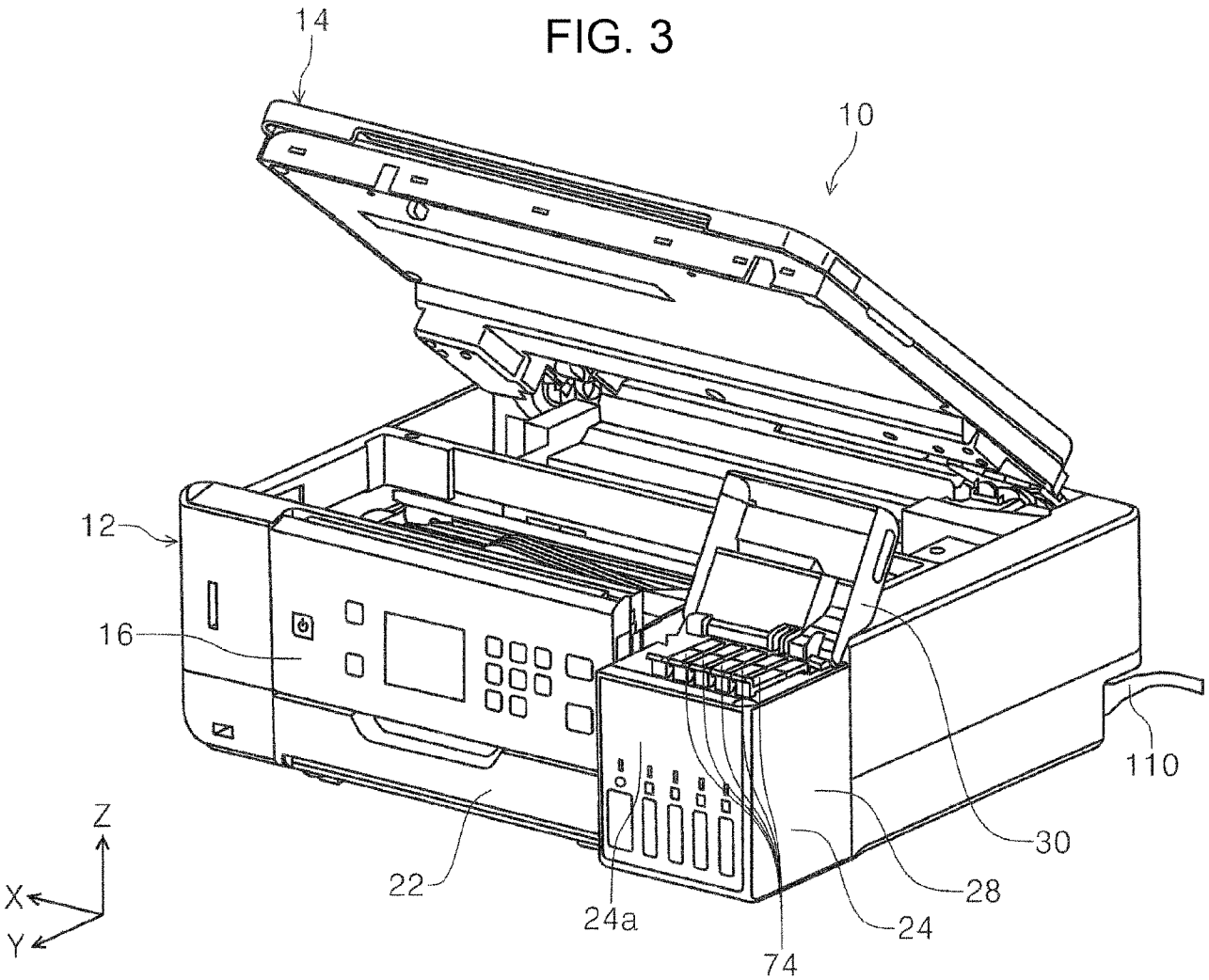
FIG. 3 is an outer appearance perspective view of the printer in which a scanner section and an ink tank cover are in an open state to an apparatus main body.
Figure 4:
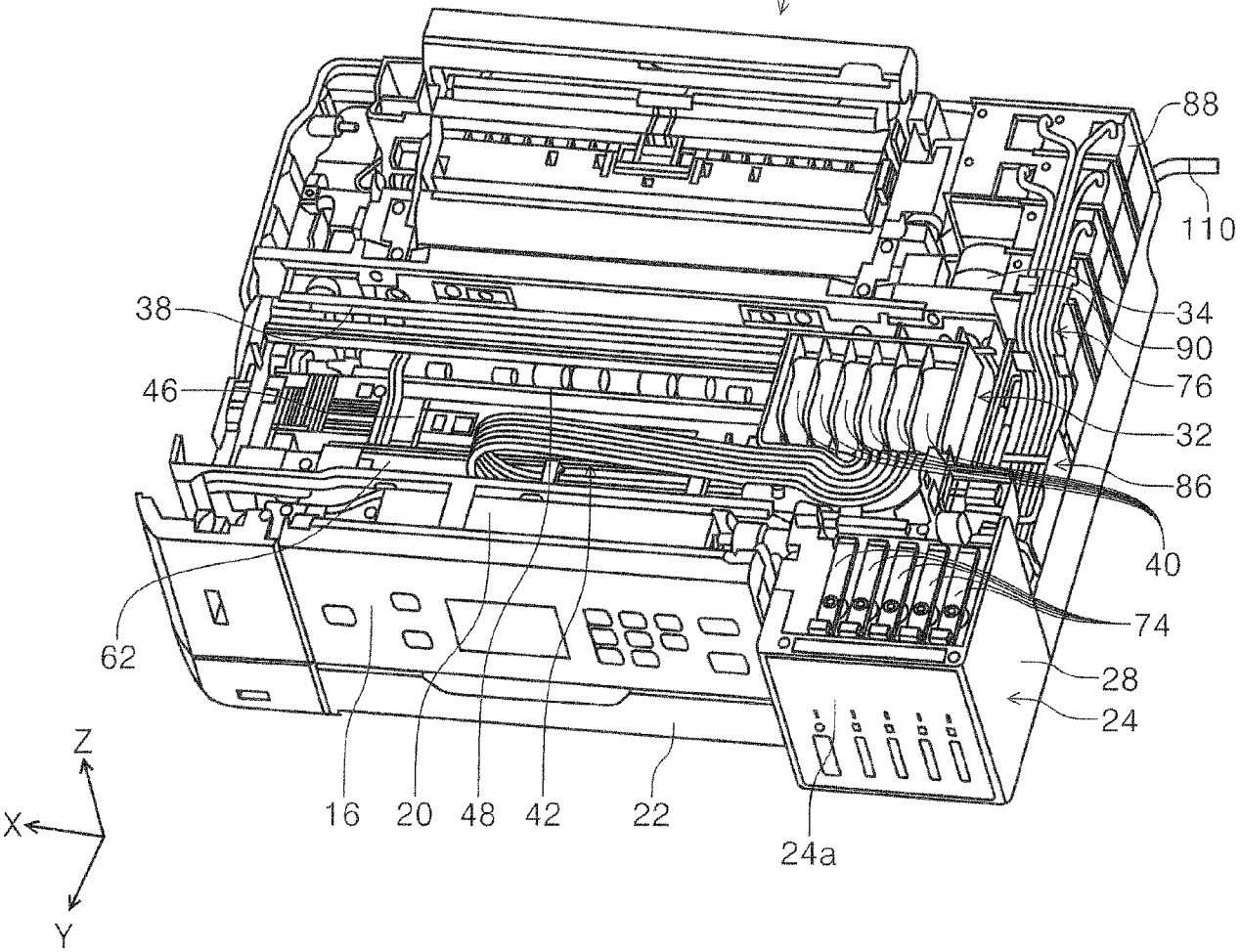
FIG. 4 is an outer appearance perspective view of the apparatus main body.
Figure 5:
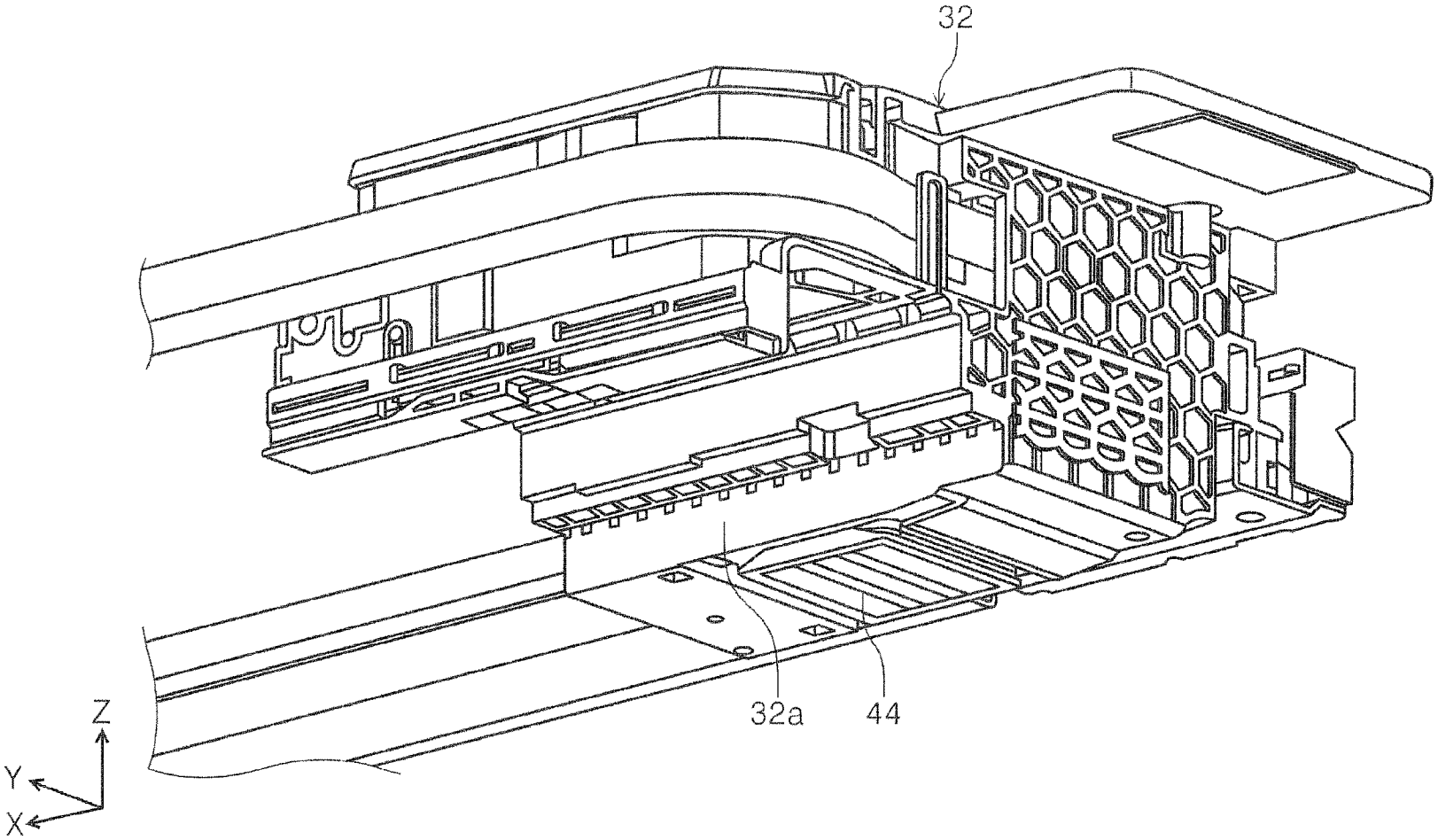
FIG. 5 is a perspective view of a carriage as viewed from obliquely below in an apparatus height direction.
Figure 6:
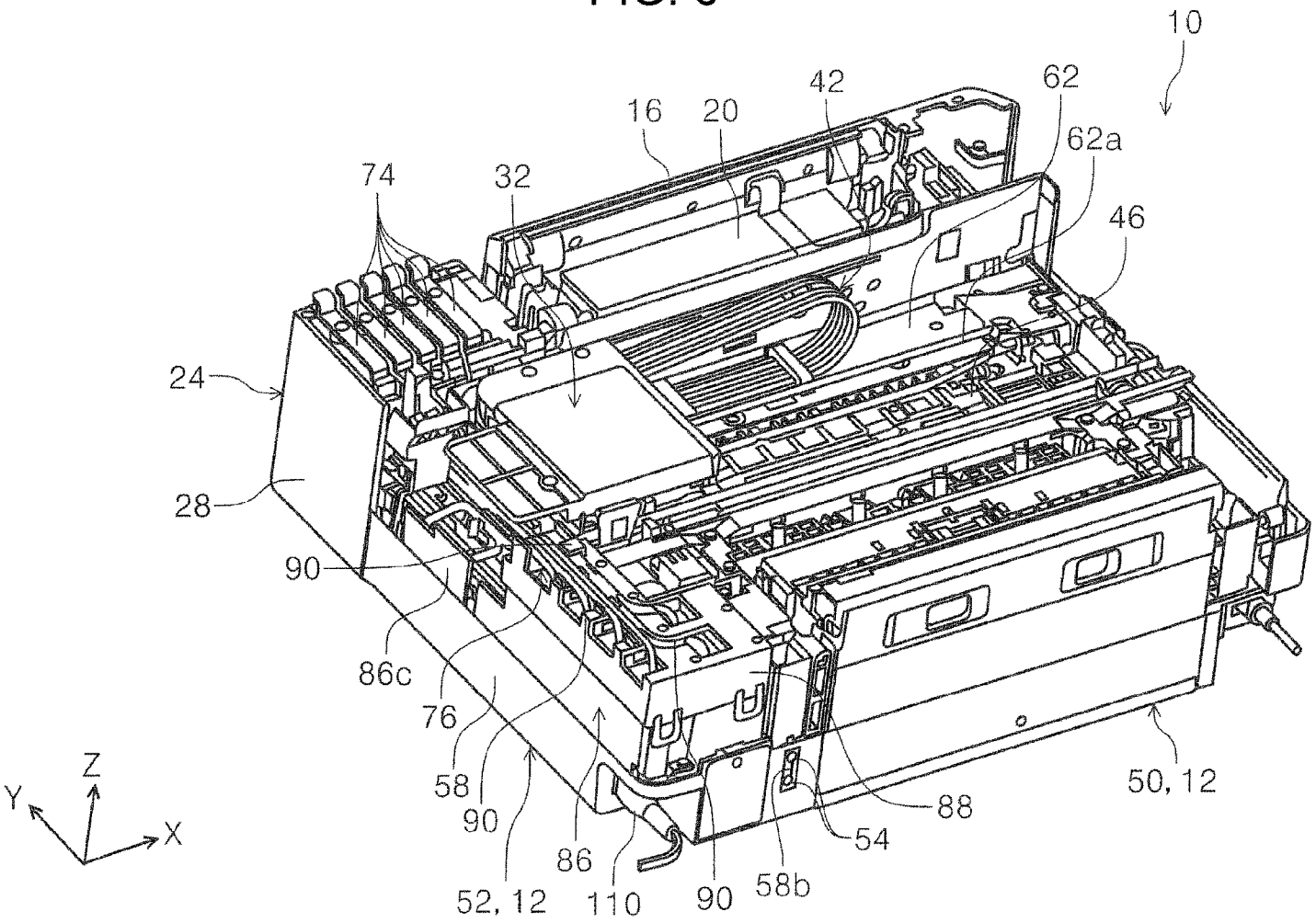
FIG. 6 is an outer appearance perspective view of the apparatus main body as viewed from a rear side in an apparatus depth direction.

FIG. 1 is an outer appearance perspective view of a printer according to the present invention, FIG. 2 is an outer appearance perspective view of the printer in a state where an operation section has been rotated forward in an apparatus depth direction, FIG. 3 is an outer appearance perspective view of the printer in which a scanner section and an ink tank cover are in an open state to an apparatus main body, buffer tank, FIG. 4 is an outer appearance perspective view of an apparatus main body, FIG. 5 is a perspective view of a carriage as viewed from obliquely below in an apparatus height direction, and FIG. 6 is an outer appearance perspective view of the apparatus main body as viewed from a rear side in an apparatus depth direction.

Figure 7:
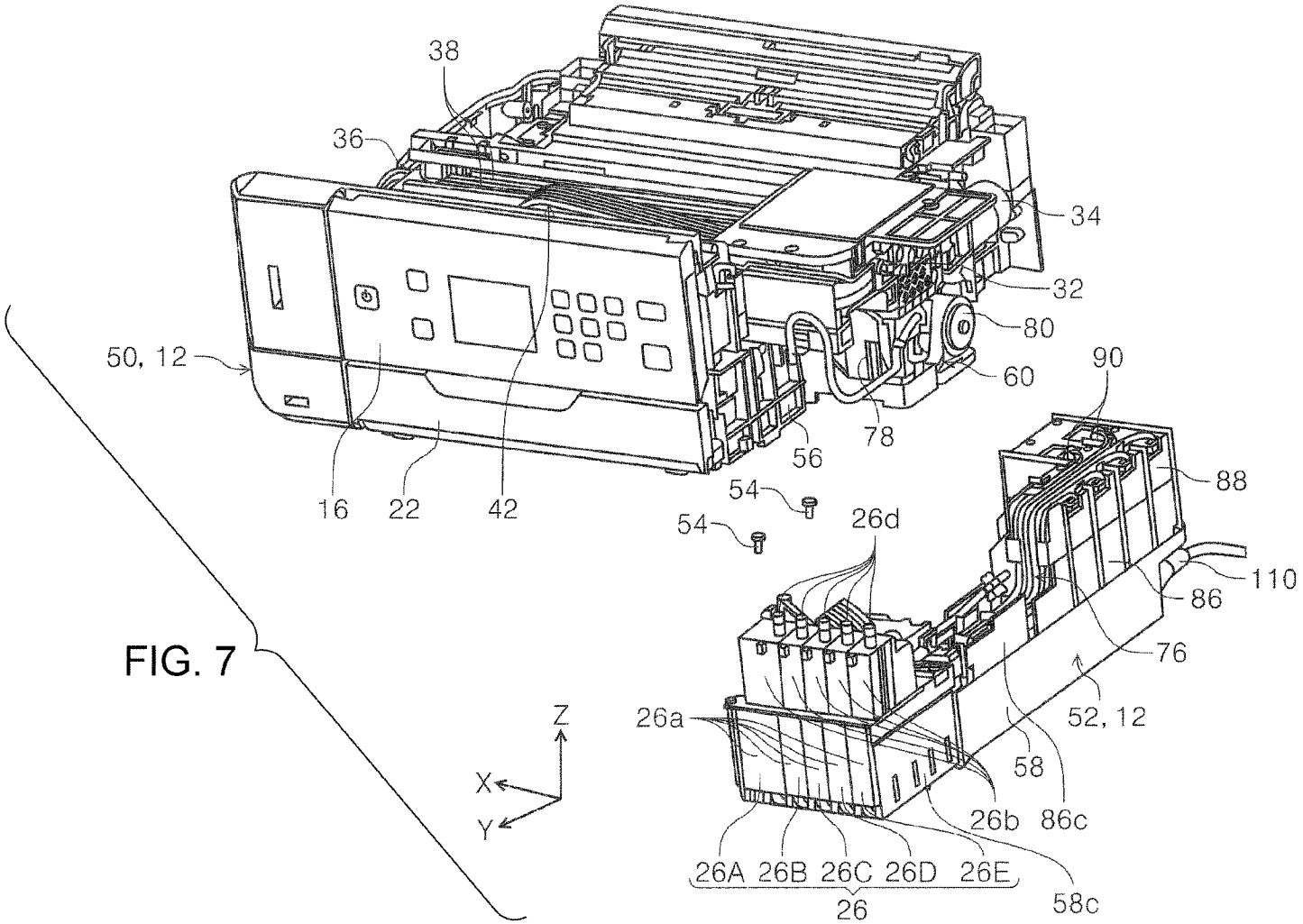
FIG. 7 is an exploded perspective view of a recording unit and an ink supply unit that constitute the apparatus main body.
Figure 8:
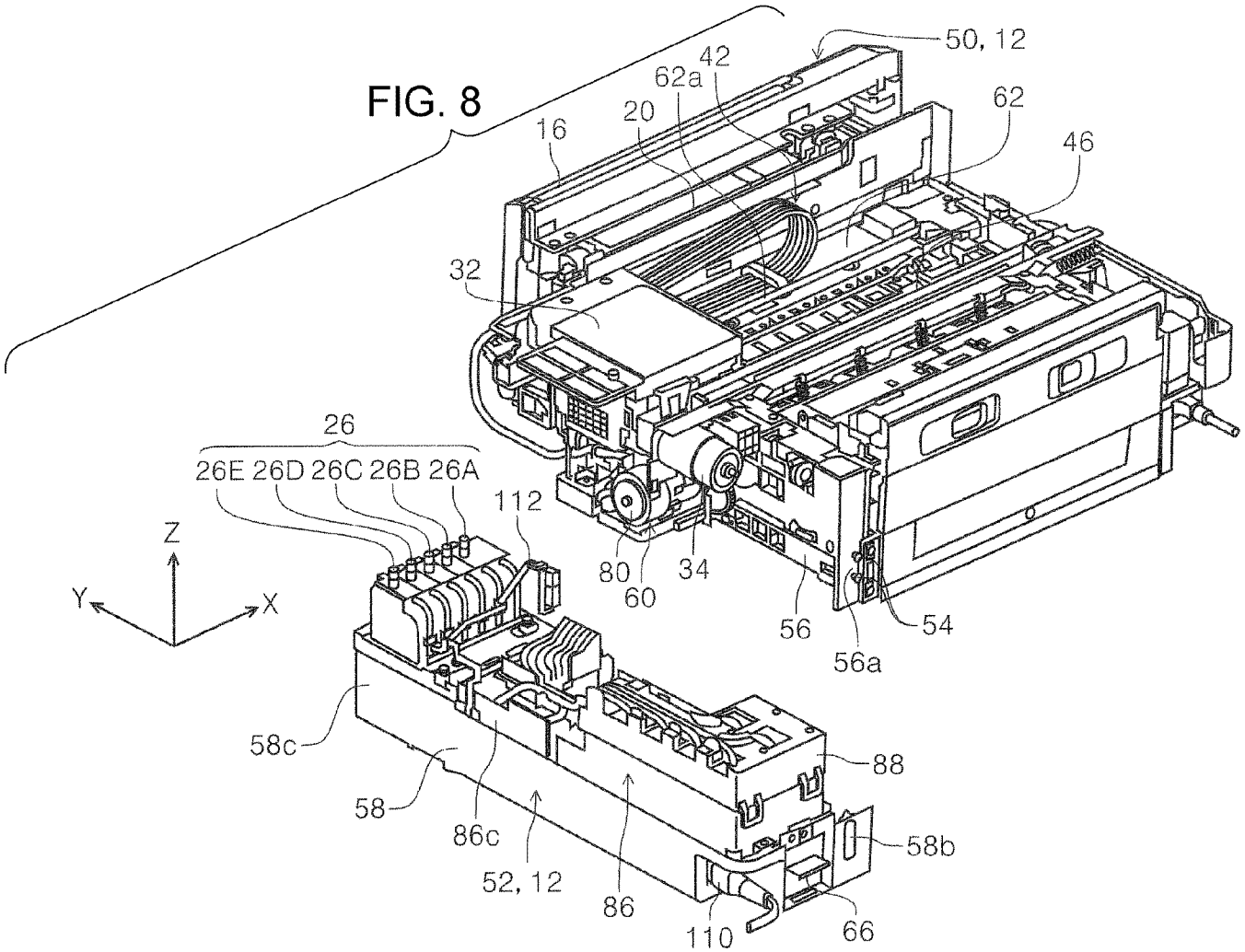
FIG. 8 is an exploded perspective view of the recording unit and the ink supply unit that constitute the apparatus main body.
Figure 9:
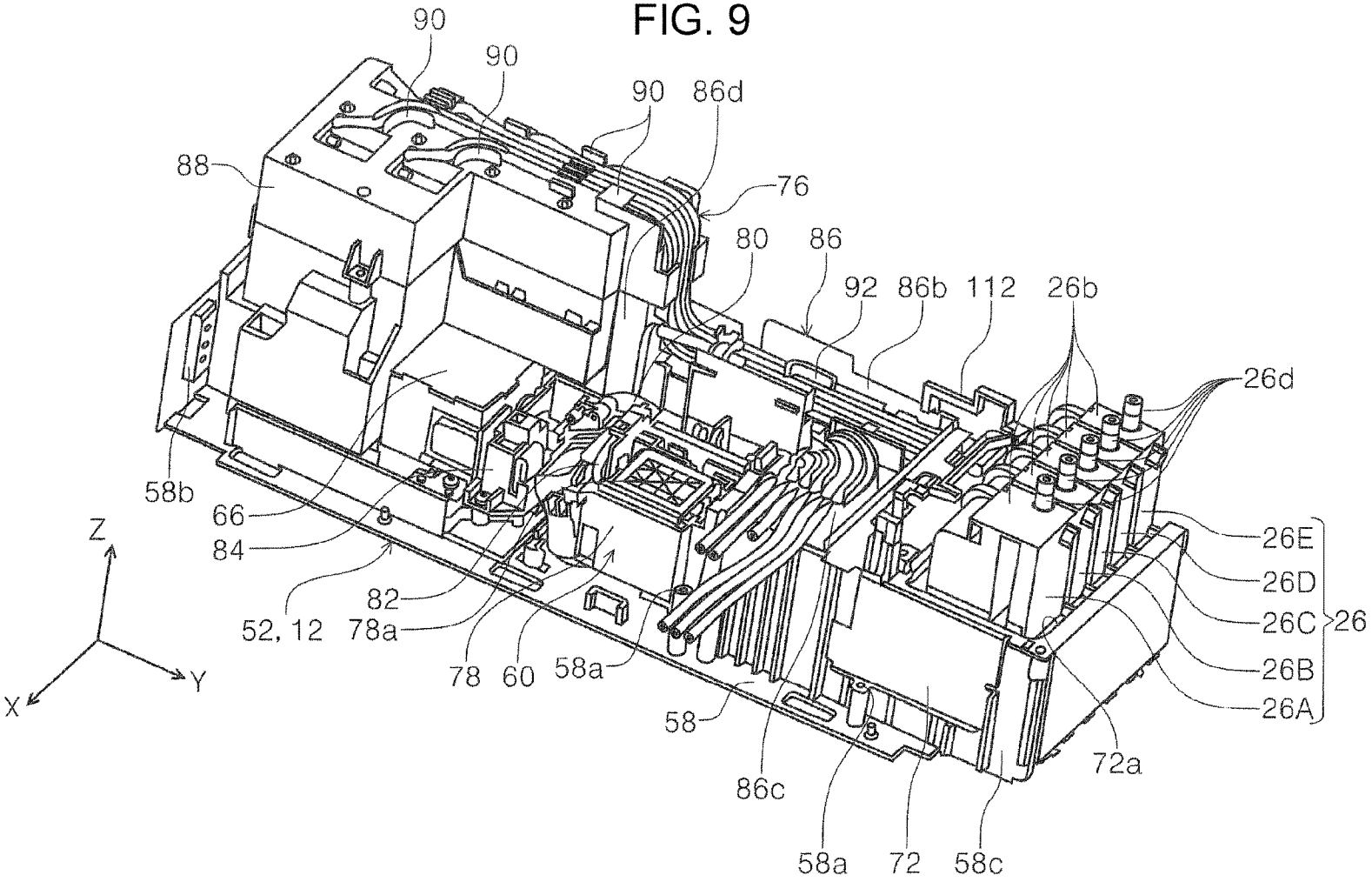
FIG. 9 is a perspective view of an ink supply unit.
Figure 10:
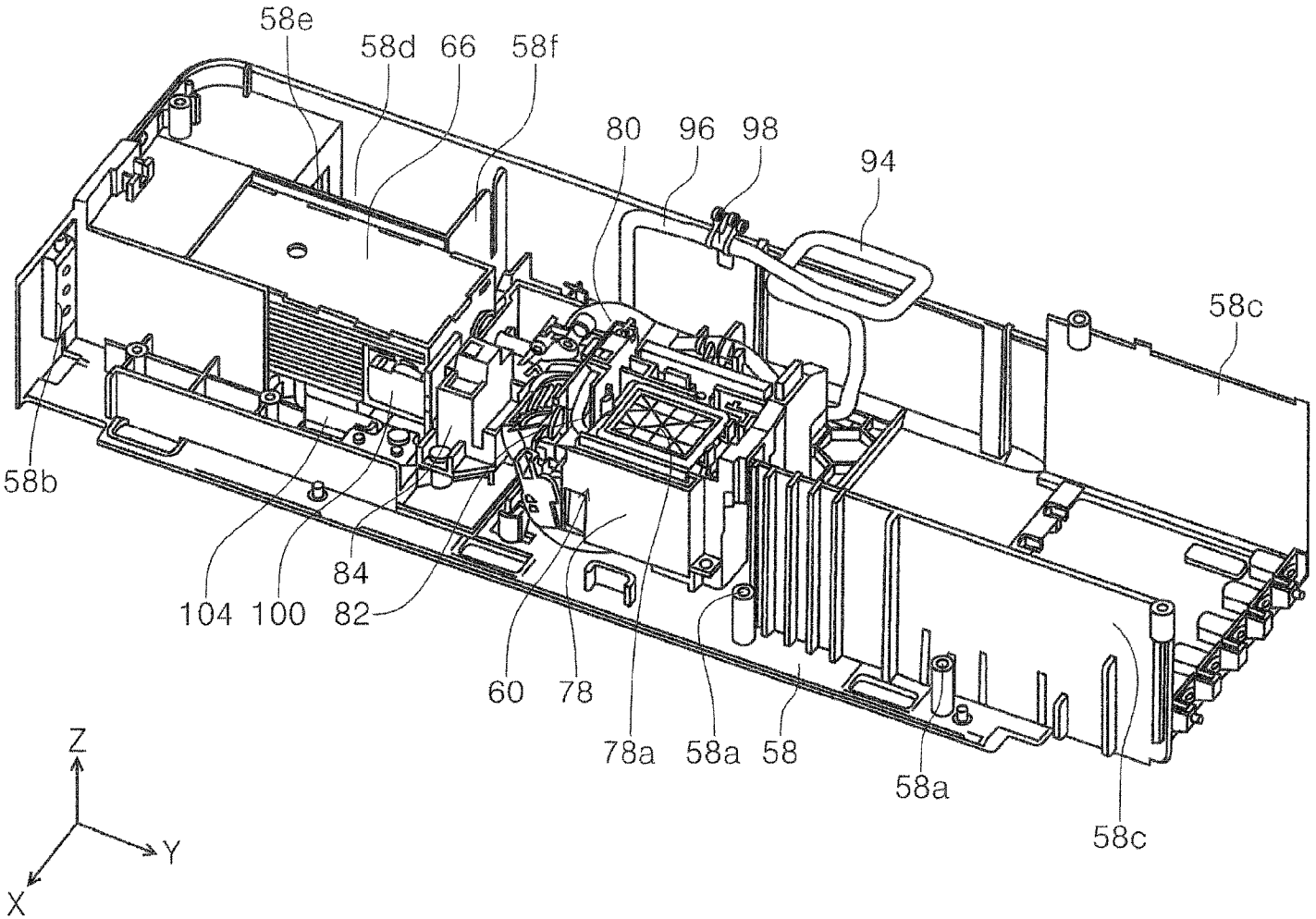
FIG. 10 is a perspective view of a maintenance unit and a waste ink tank.
Figure 11:
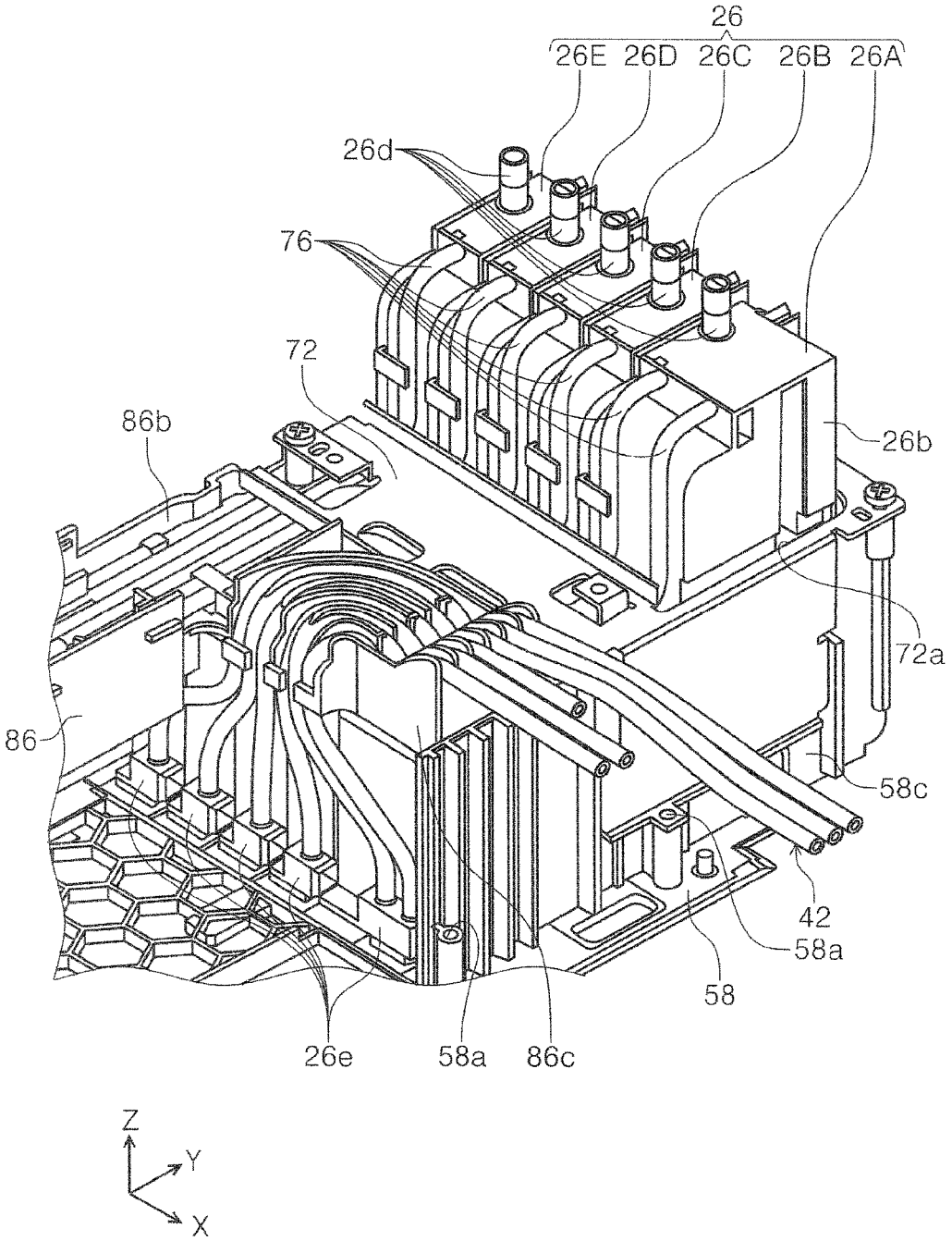
FIG. 11 is a perspective view of an ink tank.
Figure 12:
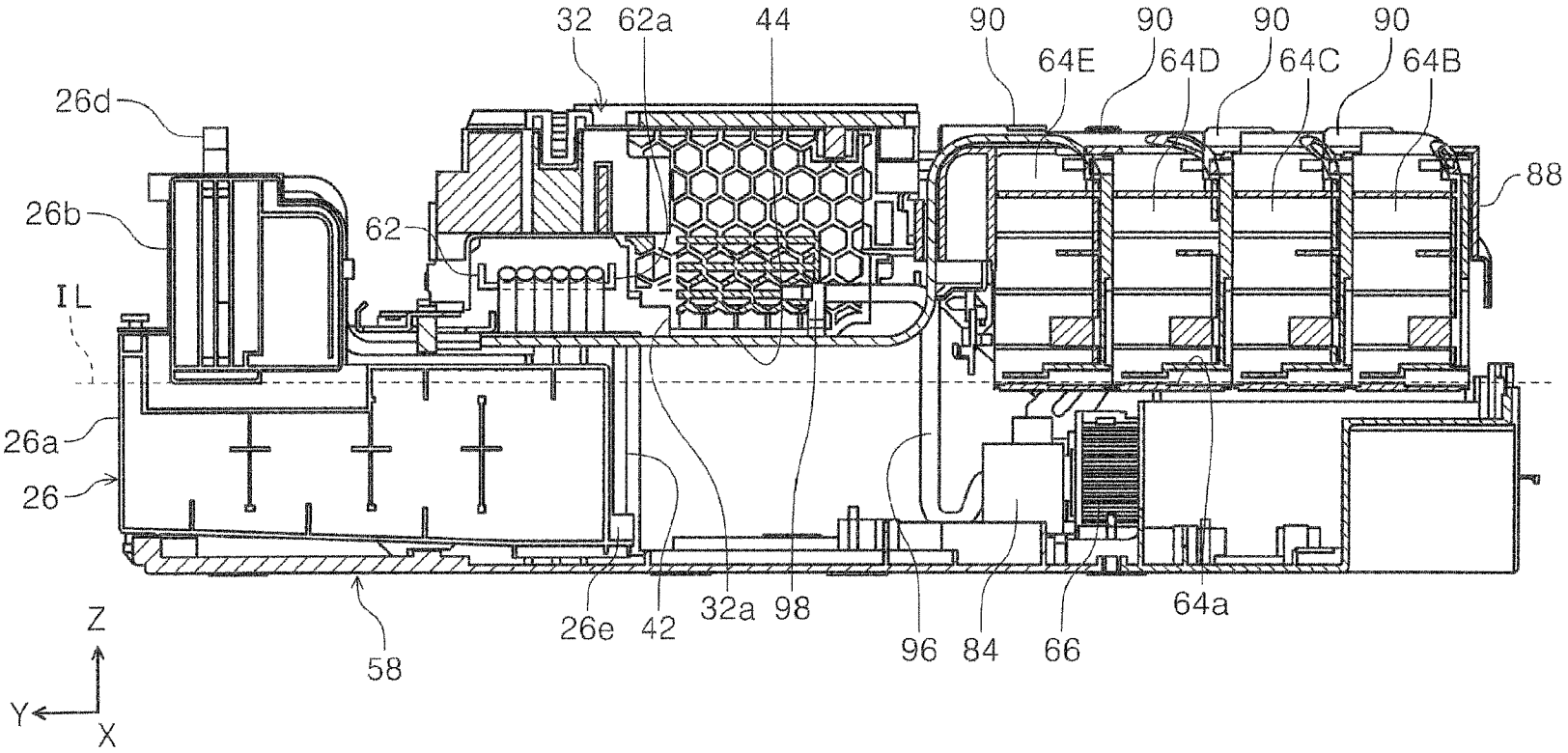
FIG. 12 is a side cross-sectional view of the ink tank, a buffer tank and the carriage that illustrates a positional relationship in the apparatus height direction.

FIG. 7 is an exploded perspective view of a recording unit and an ink supply unit that constitute the apparatus main body, FIG. 8 is an exploded perspective view of the recording unit and the ink supply unit that constitute the apparatus main body, FIG. 9 is a perspective view of an ink supply unit, FIG. 10 is a perspective view of a maintenance unit and a waste ink tank, FIG. 11 is a perspective view of an ink tank, and FIG. 12 is a side cross-sectional view of the ink tank, a buffer tank and the carriage that illustrates a positional relationship in the apparatus height direction.

Figure 13:
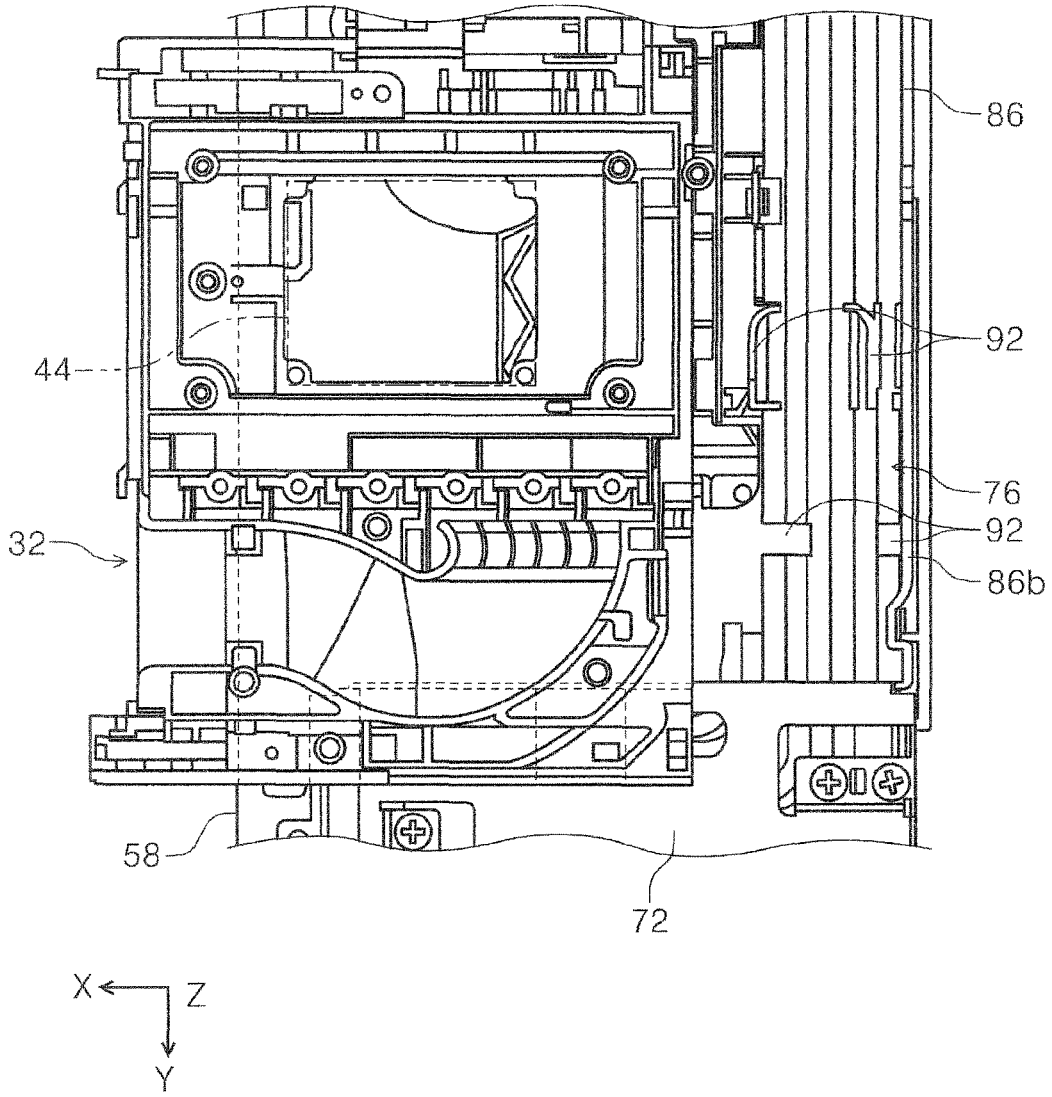
FIG. 13 a plan view of the ink tank and the carriage that illustrates a positional relationship in an apparatus width direction and the apparatus depth direction.
Figure 14:
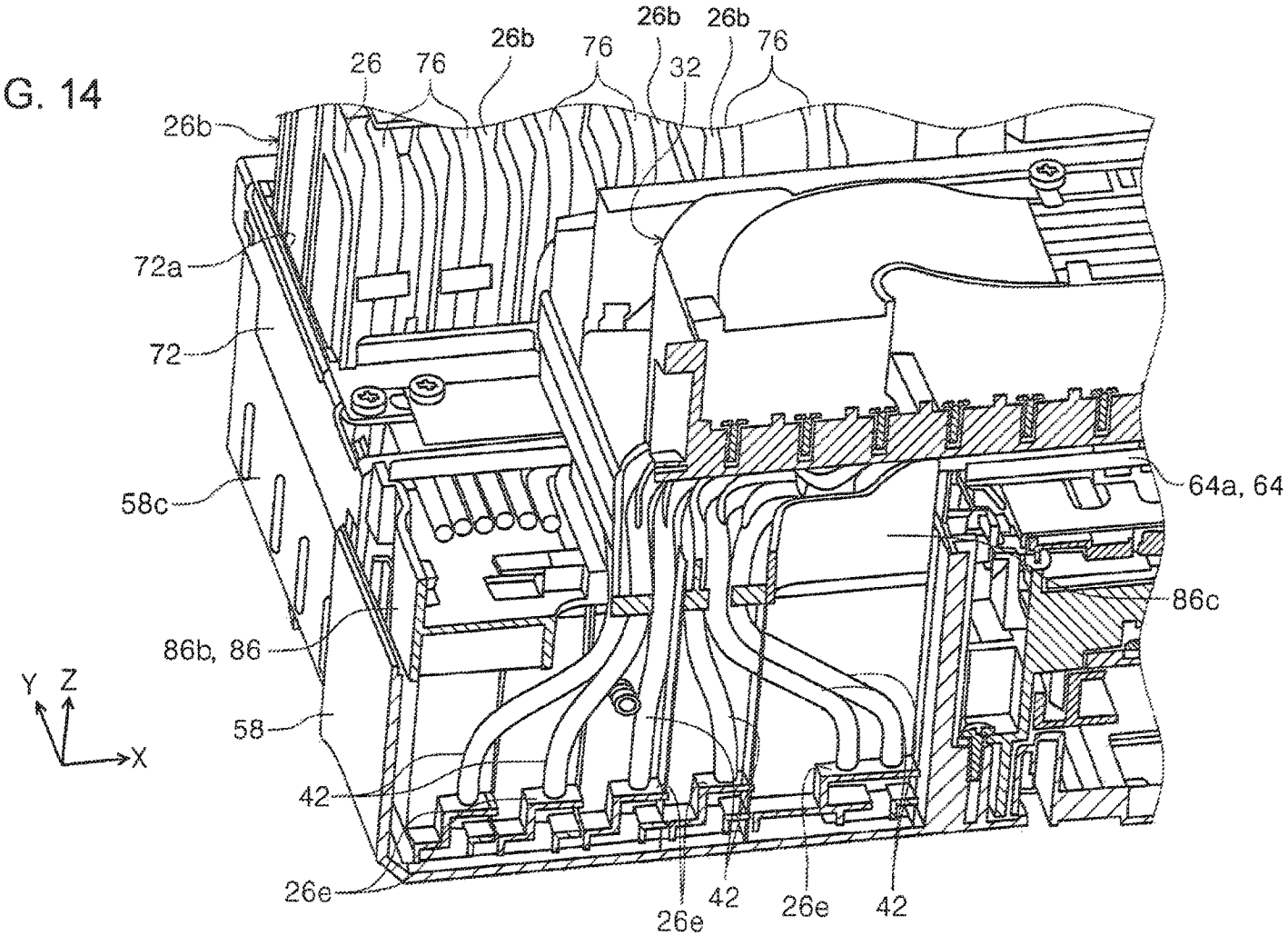
FIG. 14 is a cross-sectional view of the ink supply unit that illustrates a relationship between an ink supplying tube that extends from the ink tank and the carriage.
Figure 15:
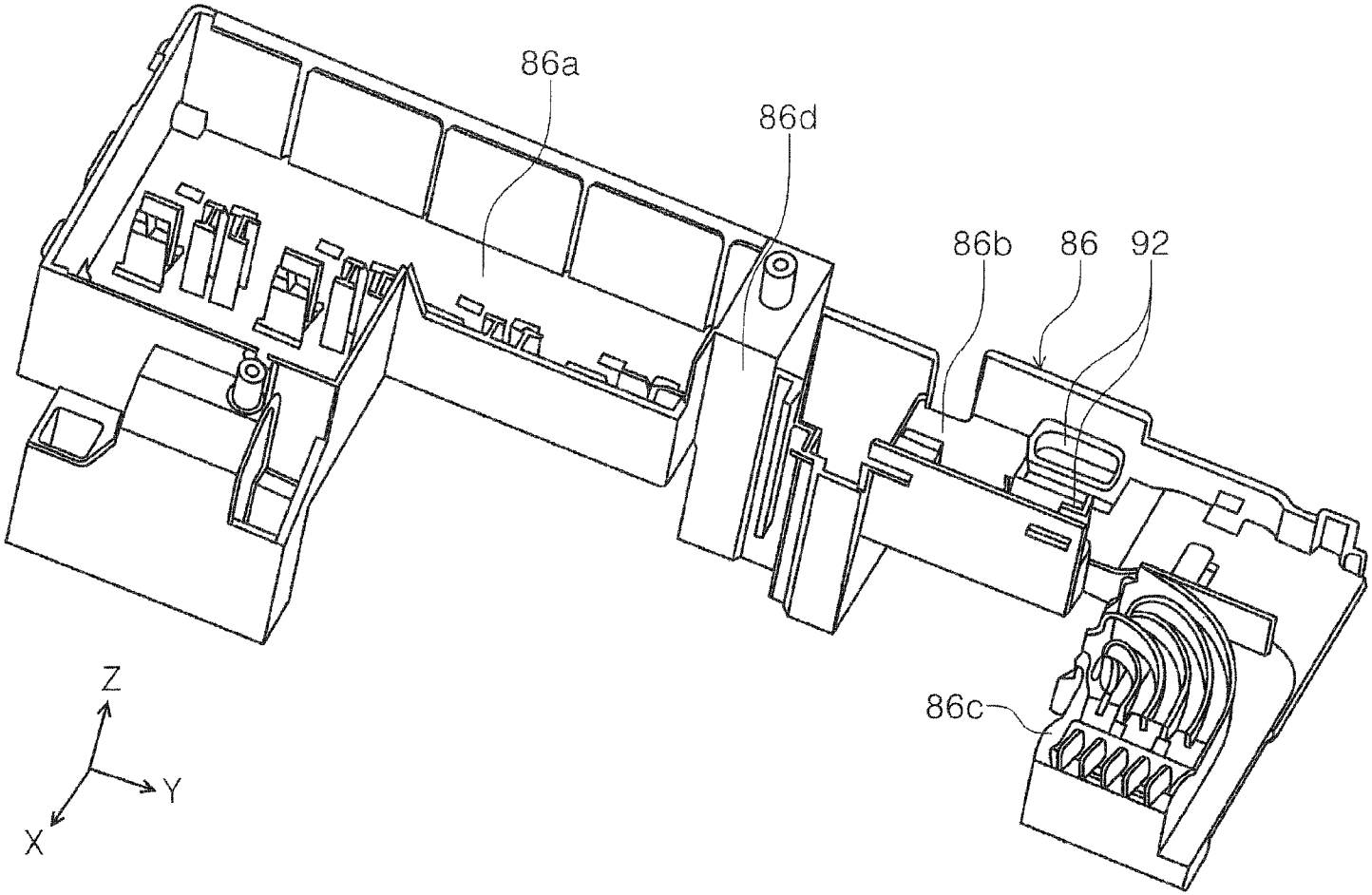
FIG. 15 is a perspective view of a first container holding member.
Figure 16:
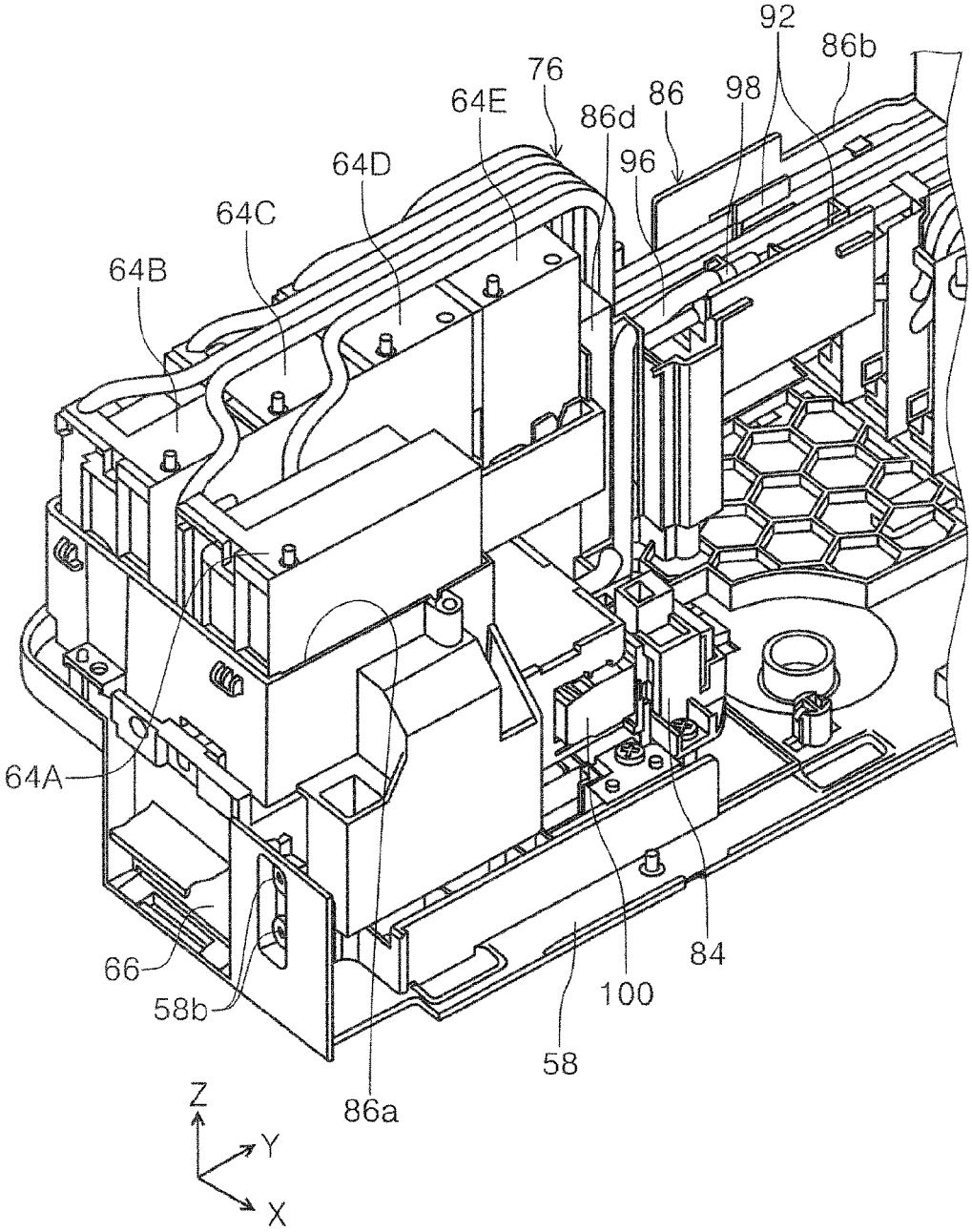
FIG. 16 is a perspective view of the buffer tank and the waste ink tank in the ink supply unit.
Figure 17:
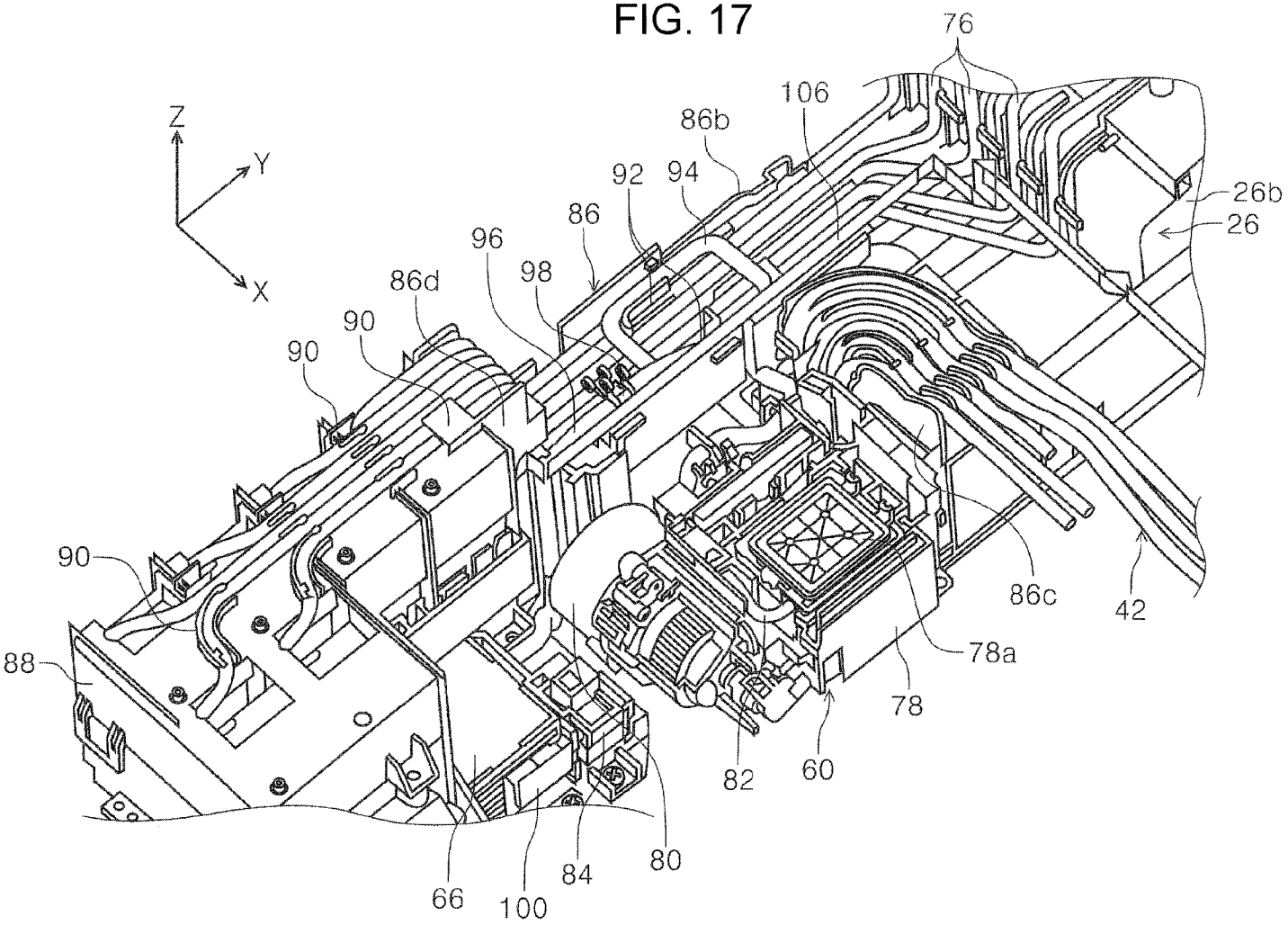
FIG. 17 is a perspective view of the ink supply unit that illustrates a routing of the ink tube.
Figure 18:
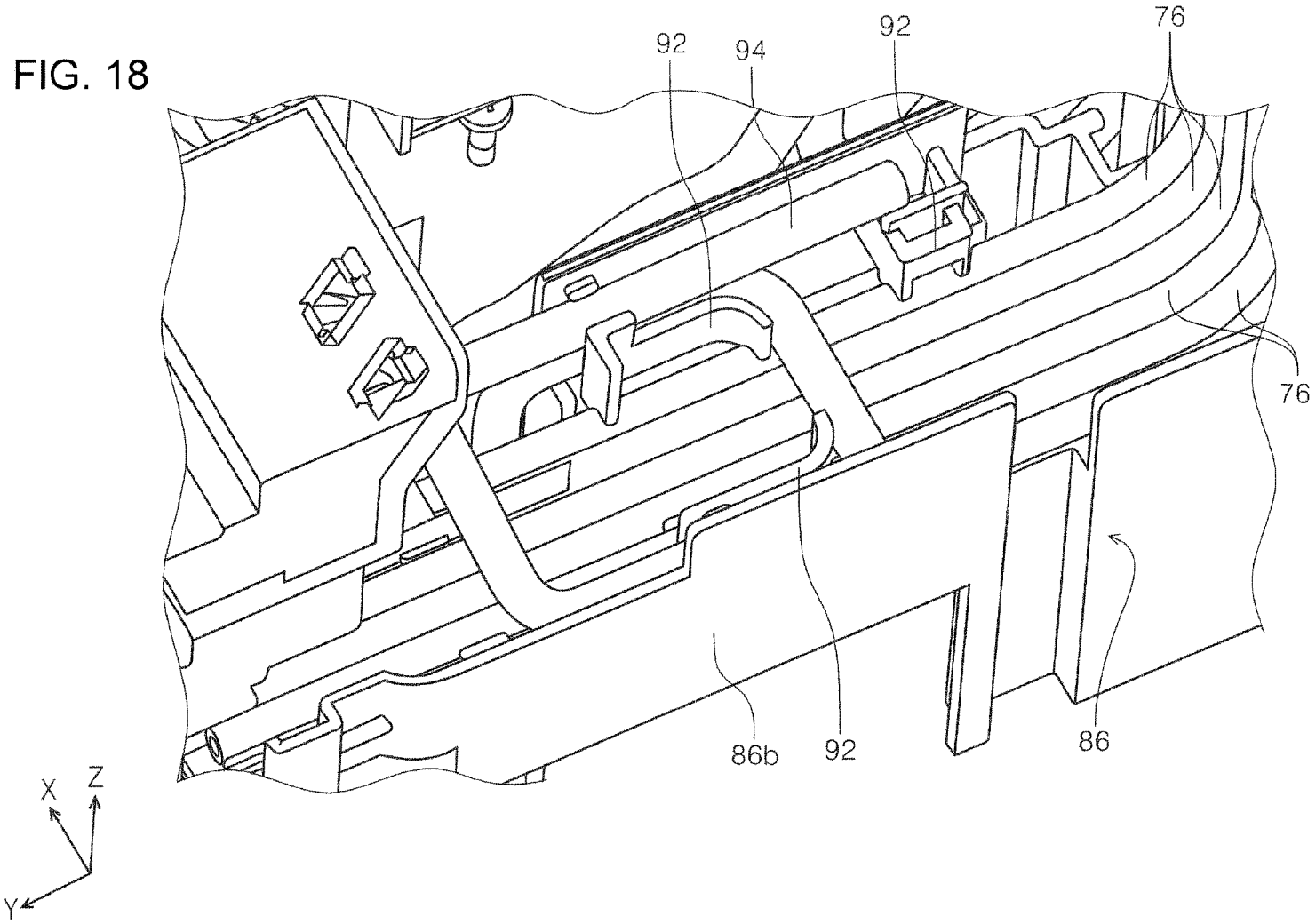
FIG. 18 is a perspective view of a flow path holding section of the container holding member.

FIG. 13 a plan view of the ink tank and the carriage that illustrates a positional relationship in an apparatus width direction and the apparatus depth direction, FIG. 14 is a cross-sectional view of the ink supply unit that illustrates a relationship between an ink supplying tube that extends from the ink tank and the carriage, FIG. 15 is a perspective view of a first container holding member, FIG. 16 is a perspective view of the buffer tank and the waste ink tank in the ink supply unit, FIG. 17 is a perspective view of the ink supply unit that illustrates a routing of the ink tube, and FIG. 18 is a perspective view of a flow path holding section of the container holding member.

Figure 19:
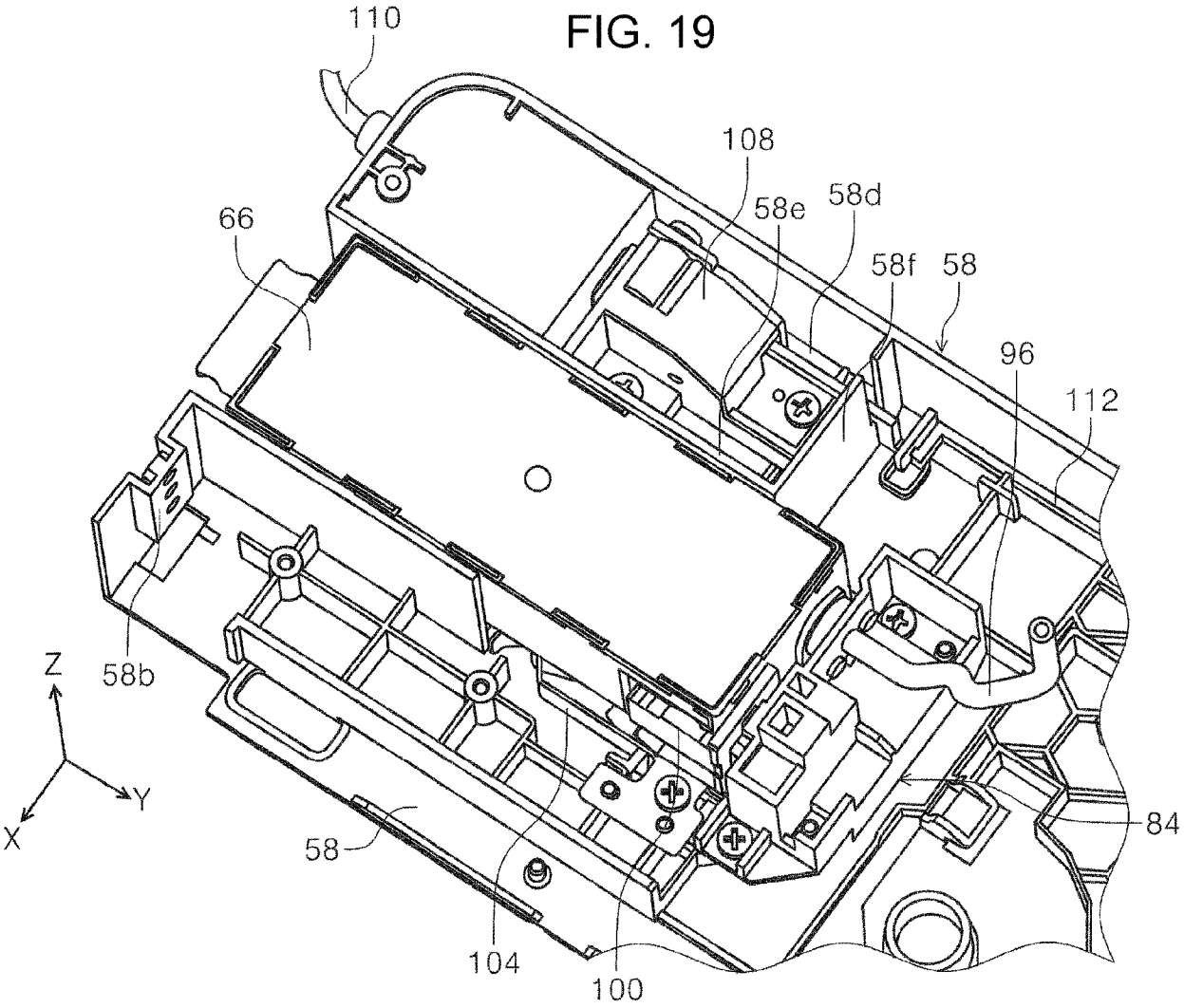
FIG. 19 is a perspective view of a waste liquid tank and a waste liquid tank mounting section.
Figure 20:
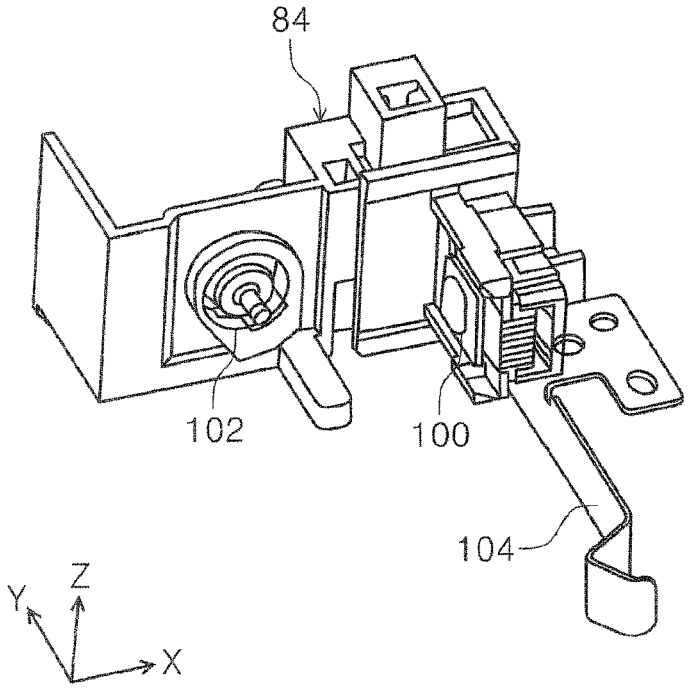
FIG. 20 is a perspective view of the waste liquid tank mounting section.
Figure 21:
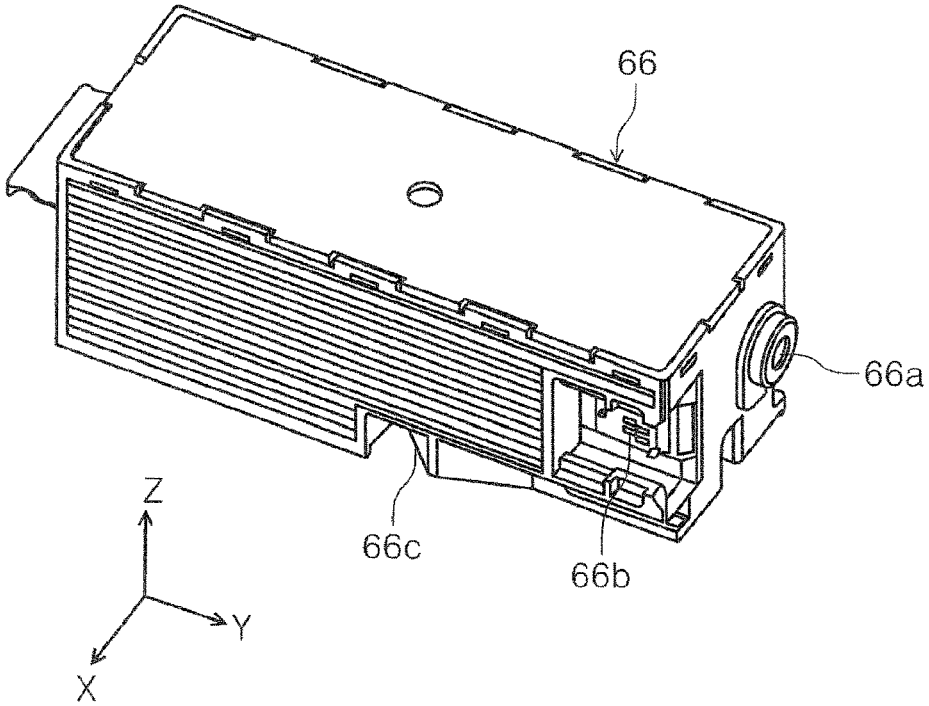
FIG. 21 is a perspective view of the waste liquid tank.
Figure 22:
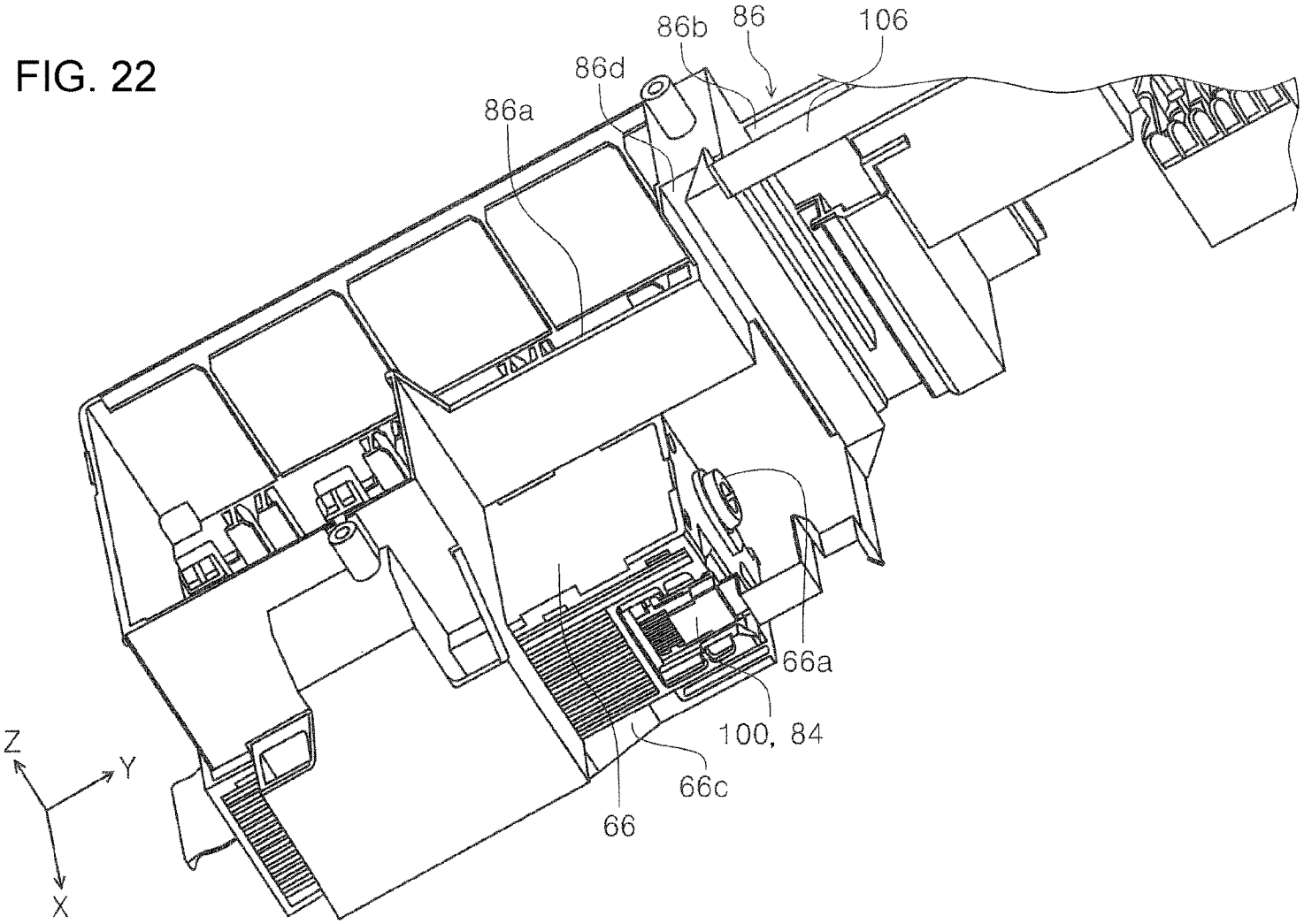
FIG. 22 is a perspective view of a wiring holding section of the container holding member and an electric wiring.
Figure 23:
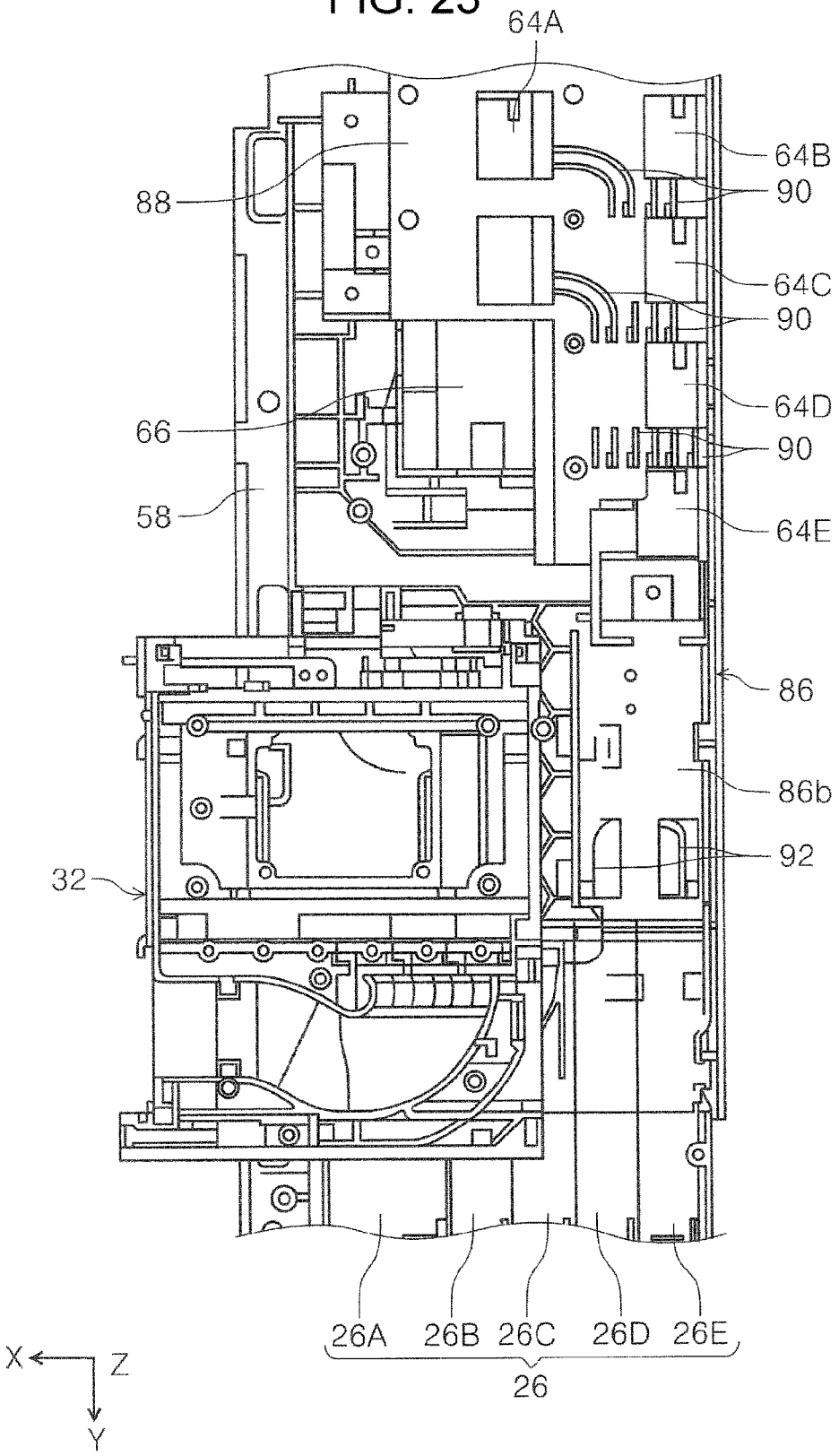
FIG. 23 is a plan view of the carriage, the waste liquid tank and the buffer tank that illustrates a positional relationship in the apparatus width direction.
Figure 24:
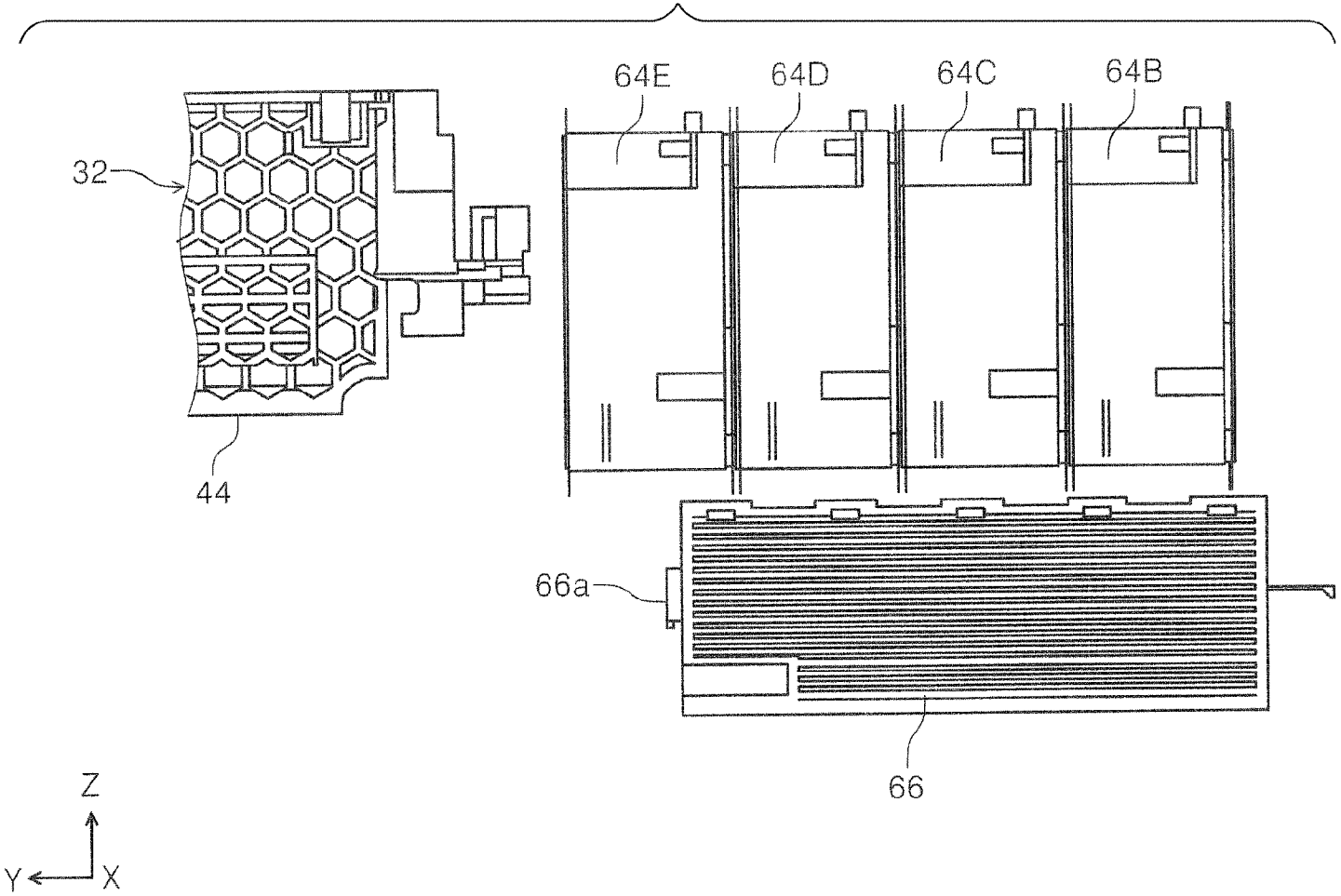
FIG. 24 is a side view of the carriage, the waste liquid tank and the buffer tank that illustrates a positional relationship in the apparatus height direction.

FIG. 19 is a perspective view of a waste liquid tank and a waste liquid tank mounting section, FIG. 20 is a perspective view of the waste liquid tank mounting section, FIG. 21 is a perspective view of the waste liquid tank, FIG. 22 is a perspective view of a wiring holding section of the container holding member and an electric wiring, FIG. 23 is a plan view of the carriage, the waste liquid tank and the buffer tank that illustrates a positional relationship in the apparatus width direction, and FIG. 24 is a side view of the carriage, the waste liquid tank and the buffer tank that illustrates a positional relationship in the apparatus height direction.

Figure 25:
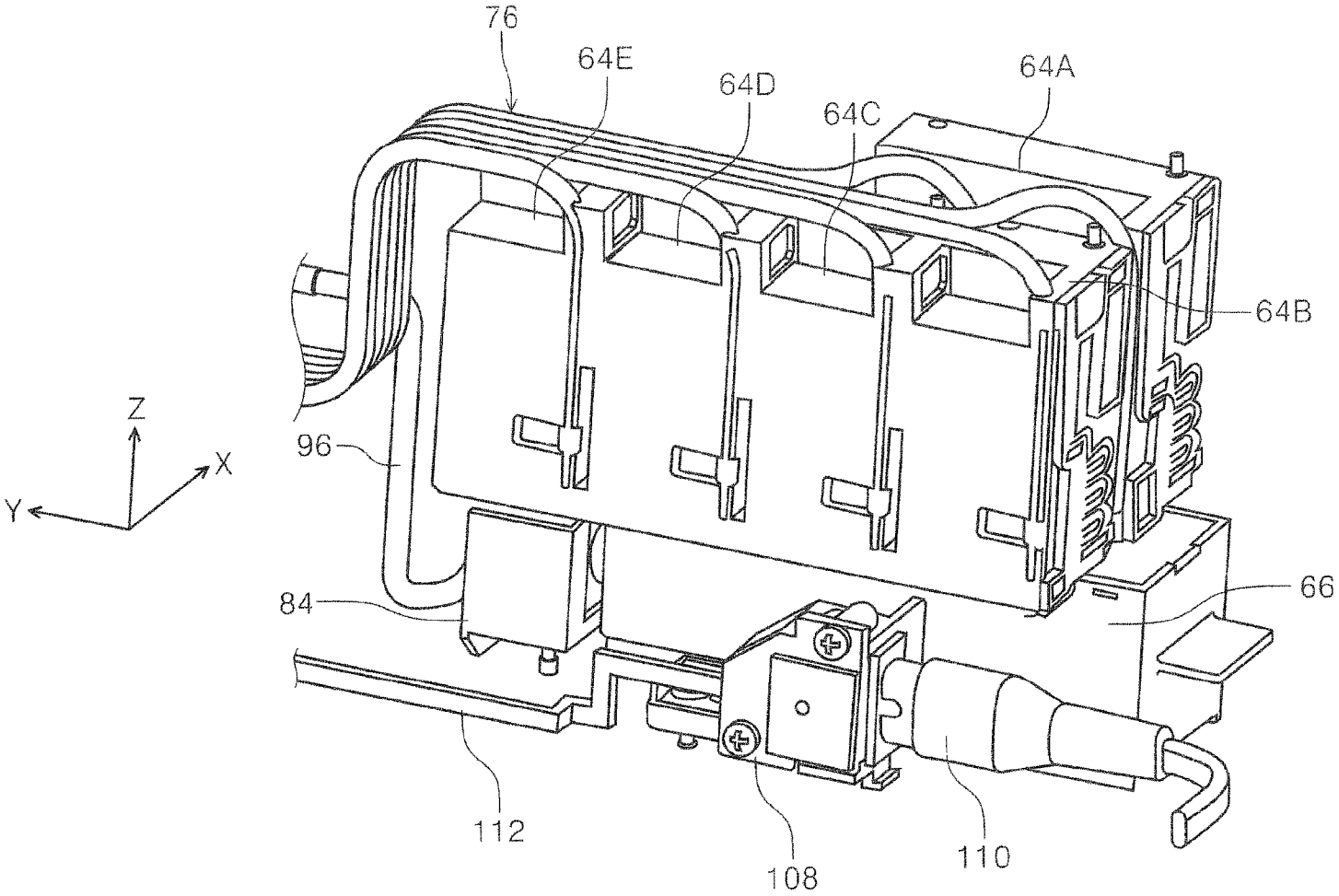
FIG. 25 is a perspective view of an inlet, the waste liquid tank and the buffer tank.
Figure 26:
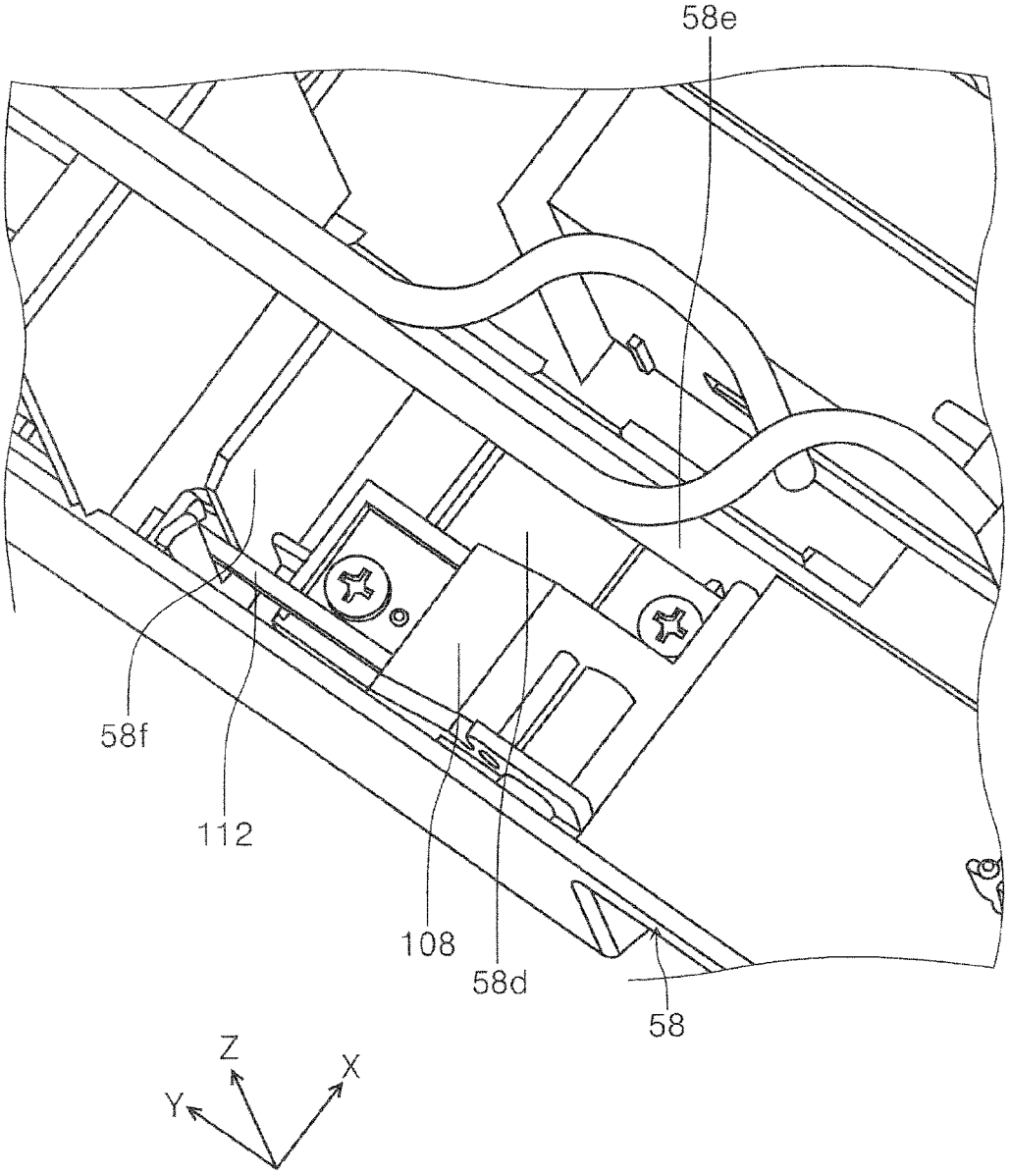
FIG. 26 is a perspective view of the inlet provided in the ink supply unit.
Figure 27:
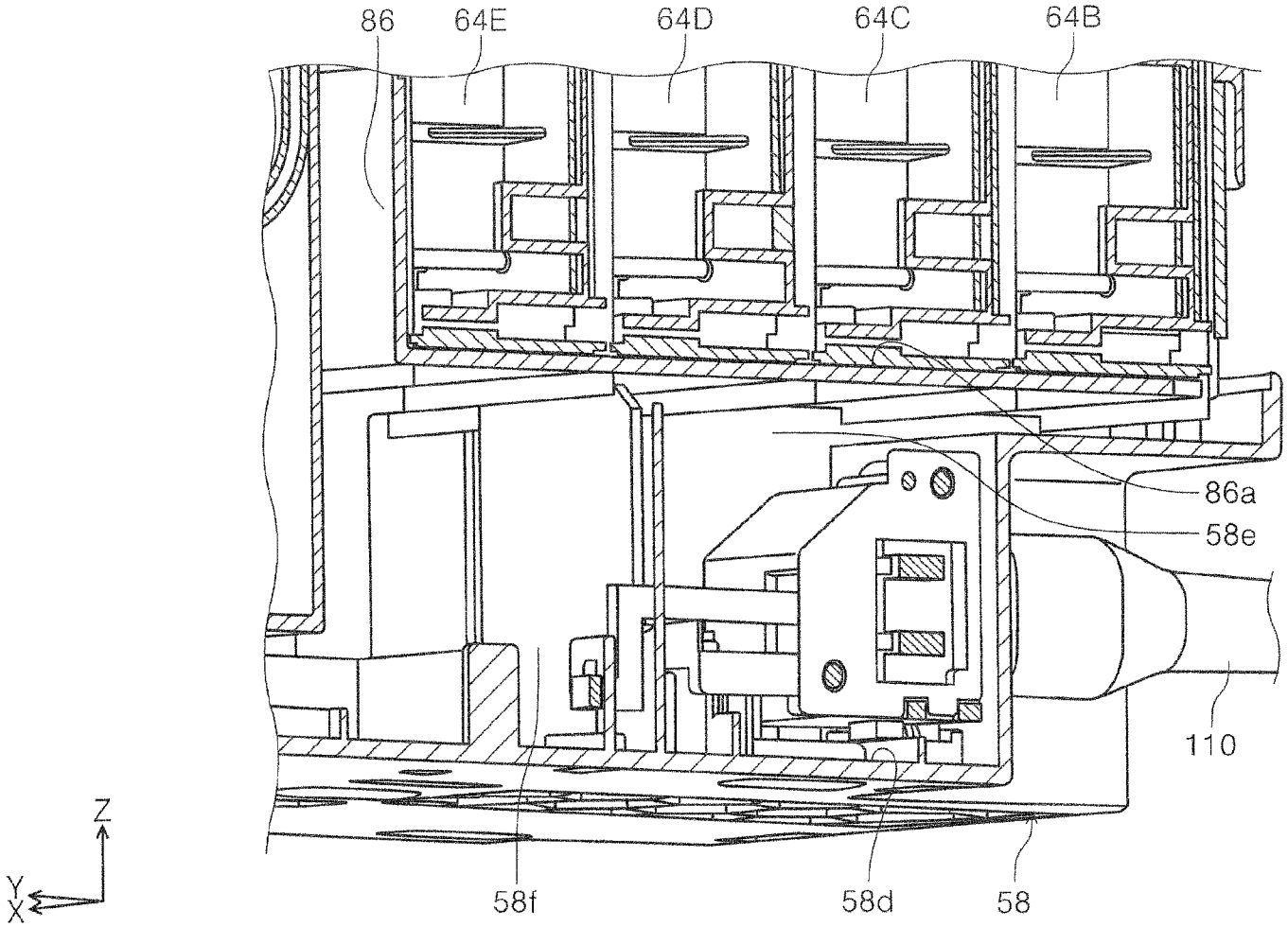
FIG. 27 is a cross-sectional view of the inlet provided in the ink supply unit.
Figure 28:
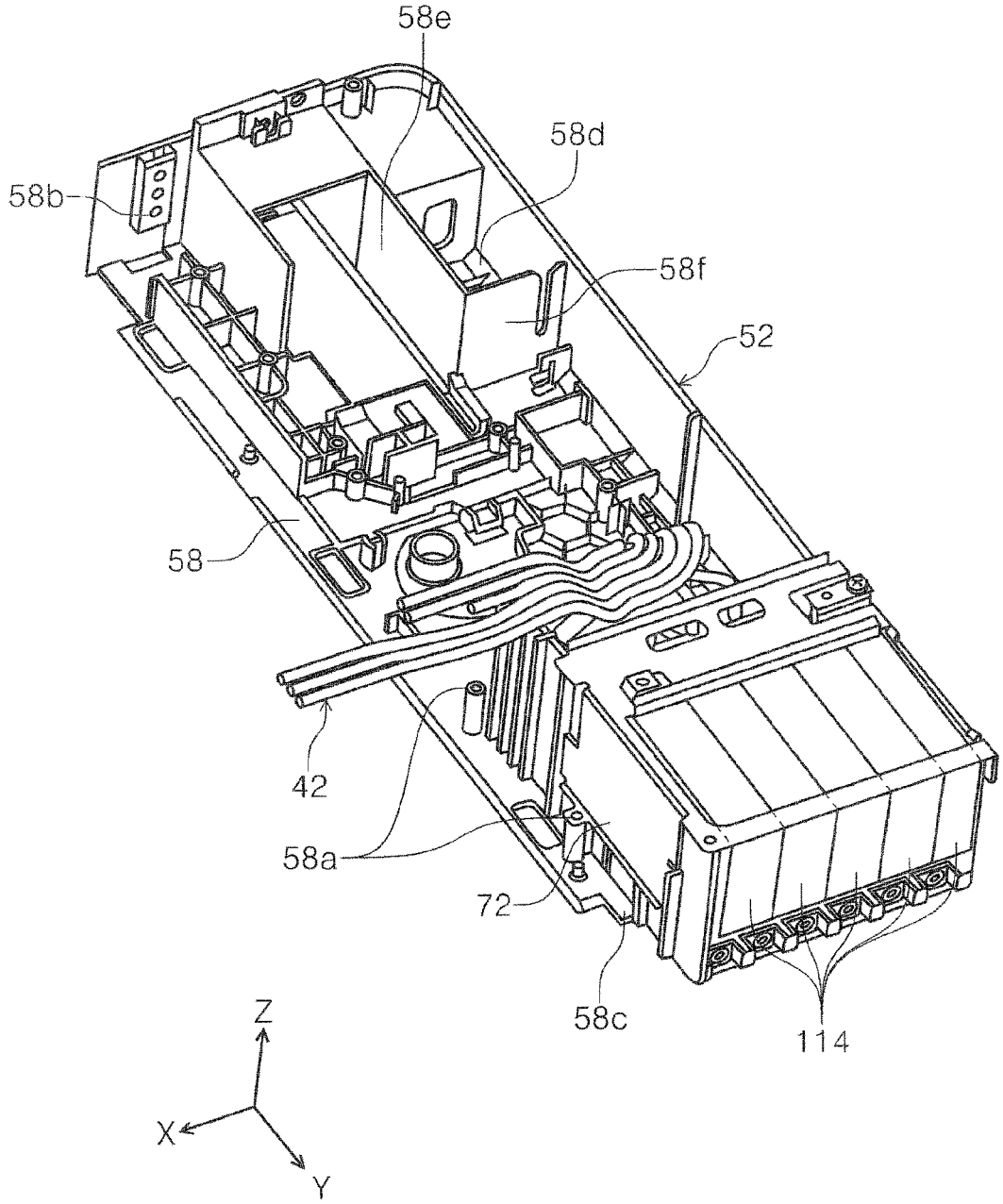
FIG. 28 is a perspective view of an example of a modification of the ink supply unit.
Figure 29:
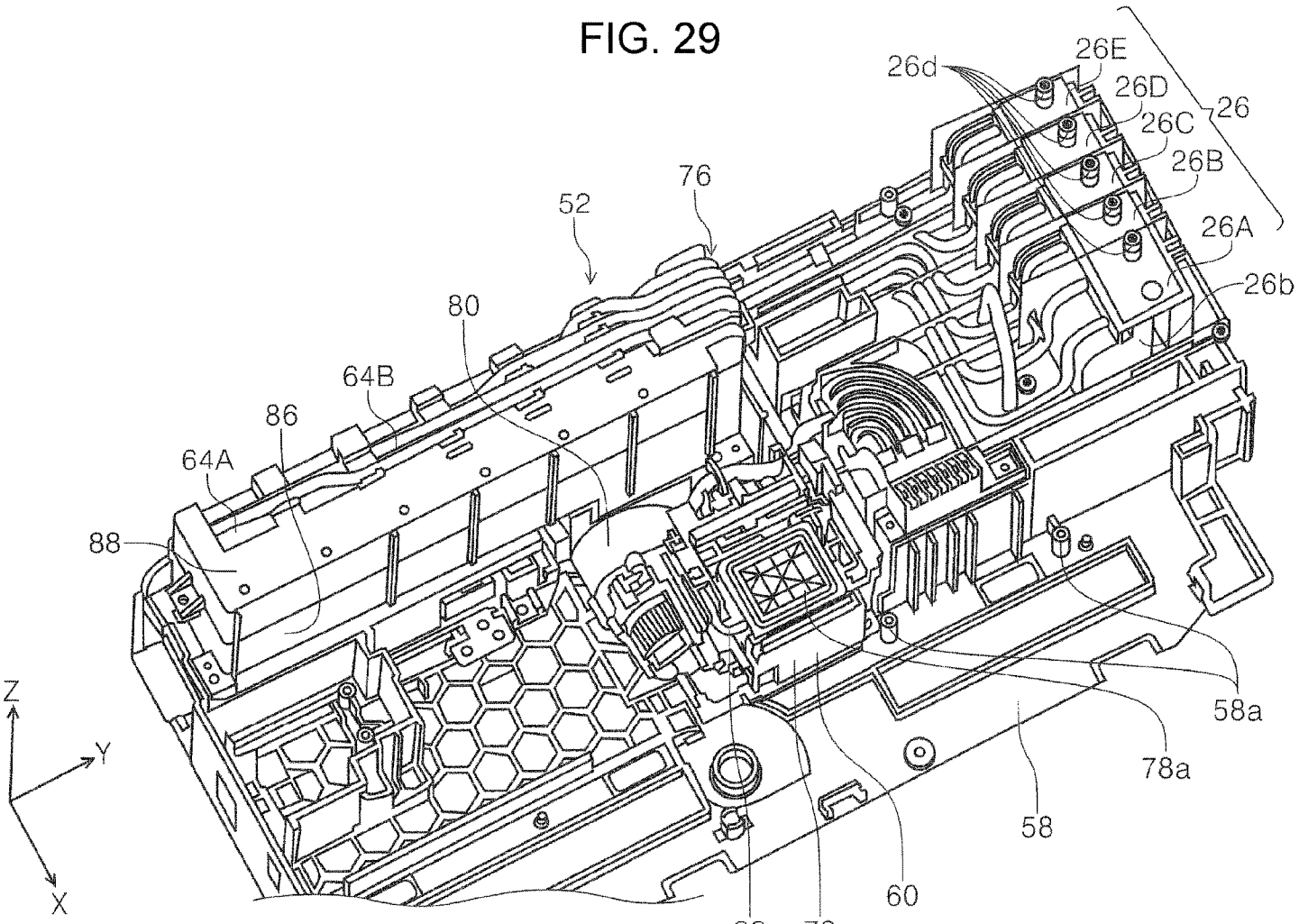
FIG. 29 is a perspective view of the ink supply unit that illustrates a modification of positioning of the buffer tank in the container holding member.
Figure 30:
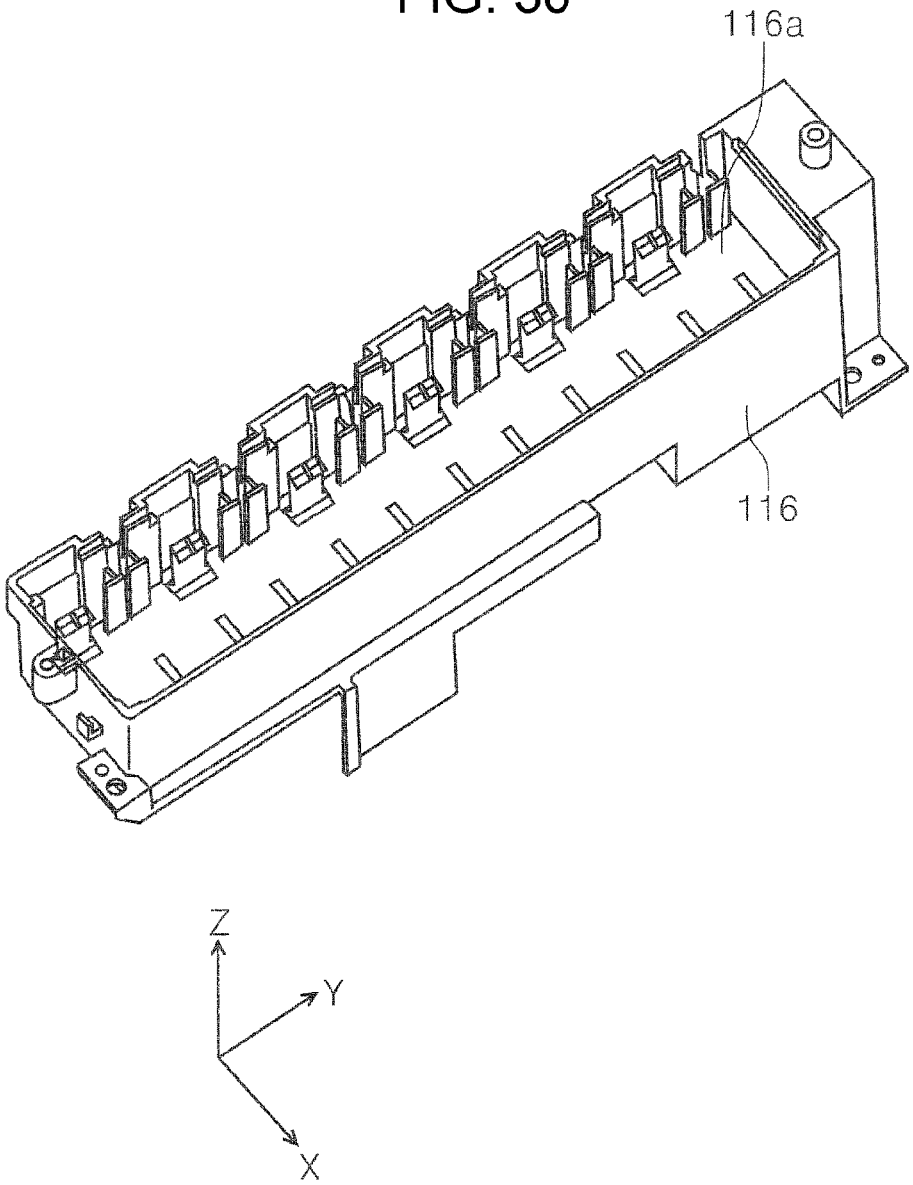
FIG. 30 is a perspective view of the container holding member in which the positioning of the buffer tank is modified.
Figure 31:
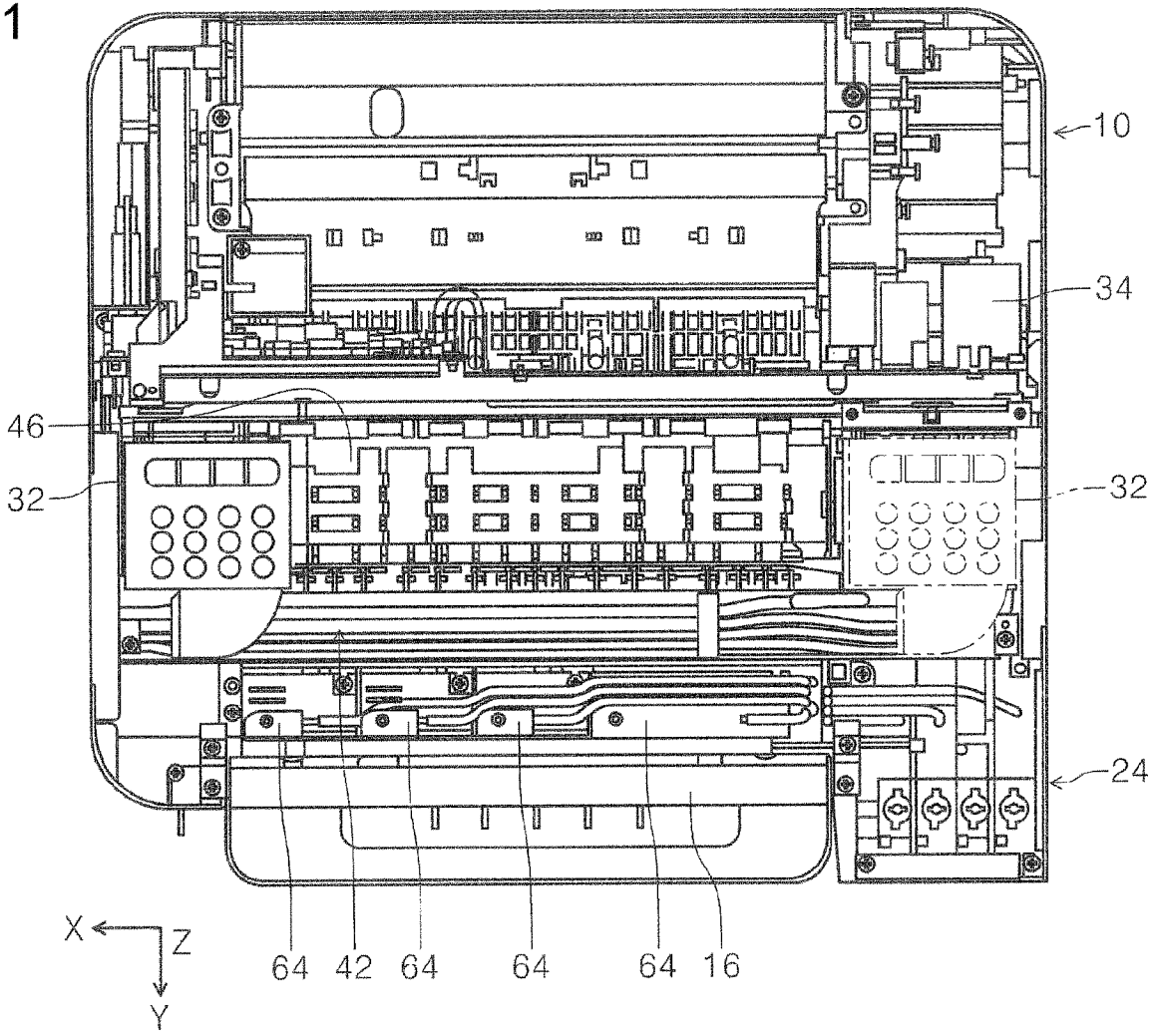
FIG. 31 is a plan view that illustrates a modification of positioning of the buffer tank in the apparatus main body.
Figure 32:
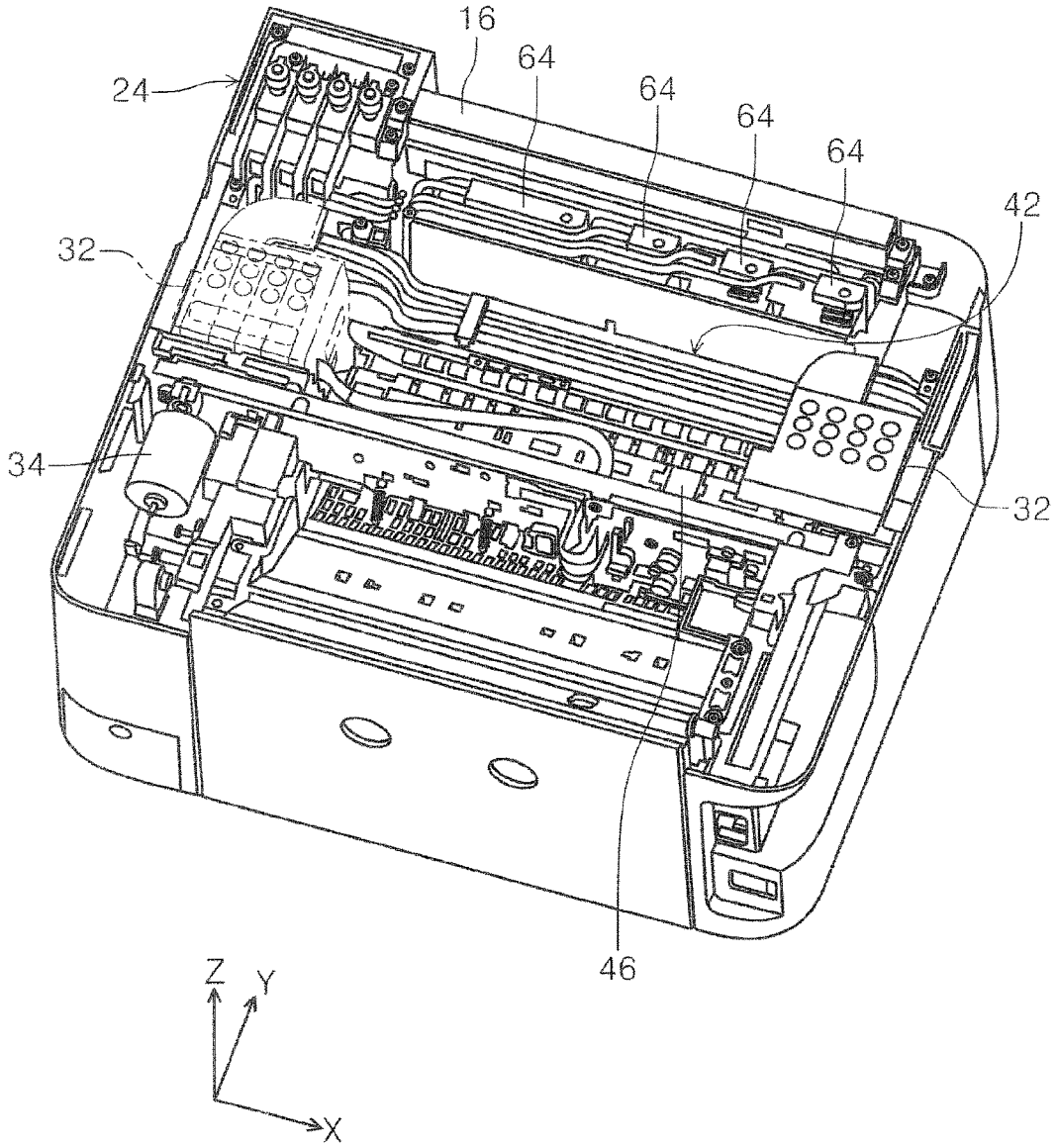
FIG. 32 is a perspective view that illustrates a modification of positioning of the buffer tank in the apparatus main body.

FIG. 25 is a perspective view of an inlet, the waste liquid tank and the buffer tank, and FIG. 26 is a perspective view of the inlet provided in the ink supply unit, and FIG. 27 is a cross-sectional view of the inlet provided in the ink supply unit, and FIG. 28 is a perspective view of an example of a modification of the ink supply unit, and FIG. 29 is a perspective view of the ink supply unit that illustrates a modification of positioning of the buffer tank in the container holding member, and FIG. 30 is a perspective view of the container holding member in which the positioning of the buffer tank is modified, and FIG. 31 is a plan view that illustrates a modification of positioning of the buffer tank in the apparatus main body, and FIG. 32 is a perspective view that illustrates a modification of positioning of the buffer tank in the apparatus main body.

Further, in the X-Y-Z coordinate system in the drawings, the X direction represents a main scan direction (movement direction) of the carriage, that is, a width direction of the recording apparatus, the Y direction represents a depth direction of the recording apparatus, and the Z direction represents a height direction of the recording apparatus. Throughout the drawings, +X direction represents the apparatus left side, −X direction represents the apparatus right side, +Y direction represents the apparatus front side, −Y direction represents the apparatus rear side, +Z direction represents the apparatus upper side, and −Z direction represents the apparatus lower side.

Embodiments

Overview of Printer

With reference to FIGS. 1 to 4, a printer 10 as an example of the "liquid ejecting apparatus" will be described. The printer 10 includes an apparatus main body 12 and a scanner 14 disposed on the upper side of the apparatus main body 12.

An operation section 16 is provided on the front side of the apparatus main body 12 in the apparatus depth direction. The operation section 16 is provided with a display means such as a liquid crystal panel as shown in FIGS. 1 to 4, and an input means having a plurality of input buttons and switches. As shown in FIG. 2, the operation section 16 is mounted on the apparatus main body 12 so as to be rotatable forward in the apparatus depth direction.

Further, as shown in FIG. 2, when the operation section 16 has been rotated forward in the apparatus depth direction relative to the apparatus main body 12, a medium output tray 18 housed in the apparatus main body 12 is exposed. The medium output tray 18 is configured to move backward and forward between a position in which it is housed in the apparatus main body 12 (see the solid line in FIG. 2) and a position in which it is pulled out forward in the apparatus depth direction from the apparatus main body 12 (see two-dotted chain line in FIG. 2).

With reference to FIGS. 4 and 6, a power supply section 20 that extends in the apparatus width direction and supplies electric power to a driving element of the printer 10 is disposed on the rear side of the operation section 16 in the apparatus depth direction. Further, the power supply section 20 supplies electric power to a control section, which is not shown in the figure, disposed in the apparatus main body 12.

Moreover, a medium container 22 that can house a medium is disposed on the lower side of the medium output tray 18 in the apparatus height direction in the apparatus main body 12 and is removably inserted into the apparatus main body 12 from the front side in the apparatus depth direction.

Moreover, with reference to FIG. 3, the scanner 14 is configured to rotate relative to the apparatus main body 12 about a rear end of the apparatus in the depth direction, and is movable between a closed position (see FIGS. 1 and 2) and an open position (see FIG. 3) relative to the apparatus main body 12.

Further, an ink tank section 24 is provided on the apparatus main body 12 on the front side in the apparatus depth direction and on the right end in the apparatus width direction in FIGS. 1 to 4. The ink tank section 24 includes a plurality of ink tanks 26 (see FIGS. 7 and 9) as a "liquid tank," a housing 28 that covers the plurality of ink tanks 26, and a cover 30 which is rotatably attached to the housing 28.

The ink tank section 24 is disposed to be located under the scanner 14 in the apparatus width direction when the scanner 14 is in at least partially closed position. In the present embodiment, five ink tanks 26 are provided as shown in FIGS. 7 and 9, and the ink tanks 26 store black, magenta, yellow, cyan and photo black colors of ink as the "liquid." Further, a display section **24*a* is provided on the front side of the ink tank section 24 in the apparatus depth direction so that the remaining amount of ink in the ink tanks 26** can be confirmed.

When the scanner 14 assumes an open position to the apparatus main body 12, the cover 30 that is disposed on the upper side of the housing 28 in the ink tank section 24 and covers the upper part of the ink tanks 26 is completely exposed. The cover 30 is rotatably attached to the housing 28. When the cover 30 is completely exposed, the upper part of the ink tanks 26 can be exposed by rotating the cover 30 relative to the housing 28 as shown in FIG. 3. The configuration of the ink tanks 26 will be described later.

Referring now to FIG. 4, a carriage 32 is disposed on the rear side of the ink tank section 24 in the apparatus depth direction. As an example, the carriage 32 is configured to reciprocate in the apparatus width direction in the apparatus main body 12. To describe the driving mechanism of the carriage 32 more specifically, a driving motor 34 is disposed on the rear side of the carriage 32 in the apparatus depth direction.

A driving pulley, which is not shown in the figure, is provided on a driving shaft of the driving motor 34. Further, a driven pulley 36 (see FIG. 7) is disposed in the apparatus main body 12 at a position spaced from the driving pulley (not shown) in the apparatus width direction in a manner to be rotatable by the driving pulley. An endless belt 38 (see also FIG. 7) is wound around the driving pulley (not shown) and the driven pulley 36. Although not shown in the figure, at least part of the endless belt 38 is held by the carriage 32 on the rear end of the carriage 32. As the driving motor 34 rotates, the endless belt 38 is rotated in the same direction as the rotation direction of the driving motor 34 to thereby move the carriage 32 in the apparatus width direction. In addition, a position of the carriage 32 in the apparatus main body 12 as shown in FIG. 4 is set as an example of a home position of the carriage 32.

Further, as shown in FIG. 4, the carriage 32 is provided with a plurality of relay adapters 40. The respective adapters 40 are connected to the ink tanks 26 via ink supplying tubes 42, which are "liquid supply path members." Further, as shown in FIG. 5, a recording head 44, which is a "liquid ejecting section" is disposed in the lower part of the carriage 32. On the underside of the recording head 44, a plurality of nozzles that eject ink is provided. Moreover, the relay adapters 40 are configured to supply ink to the nozzles of the recording head 44.

Further, in FIG. 4, a medium support member 46 that extends in the apparatus width direction is disposed on the lower side of the recording head 44. Further, a pair of transportation rollers 48 is disposed on the rear side of the medium support member 46 in the apparatus depth direction.

To describe a recording operation of the medium of the printer 10, the medium housed in the medium container 22 is fed to the pair of transportation rollers 48 by a feeding means, which is not shown in the figure. Then, the medium is nipped by the pair of transportation rollers 48, and is transported to a region under the recording head 44 and facing the recording head 44. The medium supported by the medium support member 46 receives ink ejected from the nozzles of the recording head 44 on the surface which faces the recording head 44. Thus, recording is performed on the surface of the medium which faces the recording head 44. Then, the medium on which recording is performed is outputted to the medium output tray 18 which protrudes forward in the apparatus depth direction of the apparatus main body 12.

Attachment and Detachment of Recording Unit and Ink Supply Unit

Next, with reference to FIGS. 6 to 9, the configuration of the apparatus main body 12 will be described. The apparatus main body 12 includes a recording unit 50 which includes the carriage 32 having the recording head 44, and an ink supply unit 52 configured to be detachably attached to the recording unit 50. As an example, the ink supply unit 52 is attached to the recording unit 50 via a fastening member 54 shown in FIG. 7. In the present embodiment, the fastening member 54 is provided as a screw member.

Attachment and detachment of the recording unit 50 and the ink supply unit 52 will be more specifically described below. The recording unit 50 includes a main base member 56, which is a "main base section" that constitutes part of the base of the apparatus main body 12. The recording unit 50, having the main base member 56 as a base member, includes the operation section 16, the medium container 22, the carriage 32 and the like to perform recording onto the medium. As shown in FIG. 8, a fastened section **56*a* is disposed on the rear side of the main base member 56. Further, although not shown in the figure, a plurality of fastened sections is further provided on the main base member 56** on the front side in the apparatus depth direction and on the right end in the apparatus width direction.

Further, the ink supply unit 52 includes a sub base member 58, which is a "sub base section" that constitutes part of the base of the apparatus main body 12. Referring now to FIGS. 9 to 11, fastening sections **58*a* are disposed at two positions on the sub base member 58 close to the front surface in the apparatus depth direction. Further, referring now to FIGS. 8 to 10, a fastening section 58*b* is disposed at a position on the rear end of the sub base member 58** in the apparatus depth direction.

In the present embodiment, the ink supply unit 52 is attached on the right end of the recording unit 50 in the apparatus width direction. More specifically, the fastening section **58*b* of the sub base member 58 is attached to the fastened section 56*a* of the main base member 56 of the recording unit 50 via two fastening members 54. Further, the fastening section 58*a* of the sub base member 58 is attached to a plurality of fastened sections (not shown) disposed on the front side of the main base member 56 in the apparatus depth direction, for example, via two fastening members 54. That is, the ink supply unit 52 is mounted on the recording unit 50 via four fastening members 54, and constitutes the apparatus main body 12**.

Configuration of Ink Supply Unit

Next, with reference to FIGS. 8 to 10, the configuration of the ink supply unit 52 will be described. Although a maintenance unit 60, which will be described later in conjunction with FIGS. 9, 10 and 17, is illustrated on the ink supply unit 52 for the convenience of description, it is disposed on the recording unit 50 as shown in FIGS. 7 and 8.

With reference to FIG. 9, the sub base member 58 includes the ink tank 26, a first container holding member 86, a buffer tank 64 as a "fluid containing chamber," a waste liquid tank 66 as a "waste liquid containing chamber," a second container holding member 88, and an inlet 108 (see FIG. 27).

As shown in FIG. 9, the plurality of ink tanks 26 is disposed on the front side of the sub base member 58 in the apparatus depth direction. Further, the buffer tank 64 and the waste liquid tank 66 are disposed on the rear side of the sub base member 58 in the apparatus depth direction. Further, the maintenance unit 60 is disposed in the gap between the ink tank 26, and the buffer tank 64 and the waste liquid tank 66 in the apparatus depth direction of the sub base member 58.

Ink Tank

With reference to FIGS. 7 to 9 and 11, the ink tank 26 of the present embodiment includes five ink tanks 26A, 26B, 26C, 26D, and 26E (hereinafter, comprehensively referred to as the ink tank 26). The ink tank 26A has a width larger than that of the other ink tanks 26B, 26C, 26D and 26E. That is, the ink storing amount of the ink tank 26A is larger than that of the other ink tanks 26B, 26C, 26D and 26E. Further, in the present embodiment, the ink tank 26A stores black ink.

Moreover, as shown in FIG. 12, the ink tank 26 includes an ink container 26*a* as a "first structure" which extends in the front-back direction in the apparatus depth direction on the lower side in the apparatus height direction, and an ink introducing section 26*b* as a "second structure" which protrudes upward in the apparatus height direction from the ink container 26*a*. Further, an ink introduction port 26*d* is disposed on the upper side of the ink introducing section 26*b*. As an example, the ink introducing section 26*b* is configured to have a projected area smaller than that of the ink container 26*a* when the ink tank 26 is viewed from the above in the apparatus height direction.

As shown in FIG. 9, the ink tank section 24 is disposed on the front side of the sub base member 58 in the apparatus depth direction. With reference to FIG. 10, walls 58*c*, 58*c* that protrude upward in the apparatus height direction are disposed on the opposite ends in the apparatus width direction and on the front side of the sub base member 58 in the apparatus depth direction. As shown in FIG. 9, the ink container 26*a* of the plurality of ink tanks 26 is disposed on the front side of the sub base member 58 in the apparatus depth direction and between the wall 58*c* and the wall 58*c*.

Further, a reinforcement member 72 is hung between the wall 58*c* and the wall 58*c* of the sub base member 58 so as to cover the top of the ink container 26*a*. The reinforcement member 72 reinforces the upper part of the ink container 26*a*. Further, an opening 72*a* is formed on the reinforcement member 72, and the ink introducing section 26*b* of the plurality of ink tanks 26 protrudes upward in the apparatus height direction from the opening 72*a*. The reinforcement member 72 is formed by processing a metal material, for example, by a bending work such as sheet metal working and press working.

Further, as shown in FIGS. 3, 4 and 6, the housing 28 is disposed in the ink tank section 24 on the outside of the wall 58*c* of the sub base member 58 to cover the plurality of ink tanks 26 and the walls 58*c*. Further, an ink introduction port cover 74 is rotatably mounted on the upper side of the housing 28 and is configured to switch between a closed state of the ink introduction port 22*d* and an open state of the ink introduction port 22*d*. The ink introduction port cover 74 can be accessed when the cover 30 closed to the housing 28 (see FIGS. 1 and 2) is rotated backward in the apparatus depth direction (see FIG. 3).

Further, referring to FIG. 11, connecting sections 26*e* are disposed in the lower part on the rear side of the ink container 26*a* for the respective ink tanks 26 in the apparatus depth direction. The connecting sections 26*e* are connected to the ink supplying tubes 42 that supply ink to the recording head 44 of the carriage 32.

Further, referring to FIG. 14, each ink supplying tube 42 extends upward in the apparatus height direction from the connecting section 26*e* on the rear end of the ink container 26*a* of the ink tanks 26 in the apparatus depth direction. The ink supplying tubes 42 are arrayed in the apparatus width direction in the center part of the sub base member 58, and turned forward in the apparatus depth direction, and then bent into the movement direction of the carriage 32 to thereby change the direction.

A tube guide member 62 (see FIG. 6) which extends in the apparatus width direction is disposed on the rear side of the power supply section 20 in the apparatus depth direction. The ink supplying tubes 42 are guided by the tube guide member 62 to extend from the right to the left in the apparatus width direction, and bent upward in the apparatus height direction, and then turned back and connected to the relay adapter 40 (see FIG. 4) of the carriage 32.

The position of the carriage 32 in FIG. 14 is a home position of the carriage 32 in the movement area. Further, a portion of the plurality of ink supplying tubes 42 bundled and extending upward in the apparatus height direction is located in the movement area of the carriage 32 in the apparatus width direction. In addition, the dimension of the portion of the plurality of ink supplying tubes 42 in the apparatus width direction is smaller than the width of the carriage 32.

Further, as shown in FIG. 12, a portion of the ink supplying tube 42 which extends upward in the apparatus height direction from the connecting section 26*e* is located between the rear end 62*a* of the tube guide member 62 in the apparatus depth direction and the front side end 32*a* on the lower end of the carriage 32 (see FIG. 5) as viewed in the apparatus depth direction.

Further, the upper part of the ink introducing section 26*b* of the ink tank 26 is connected to a first end of a connection tube 76, which is a "connection flow path member." In the present embodiment, two ink supplying tubes 42 and two connection tubes 76 are led out from the ink tank 26A located leftmost in the apparatus width direction.

Further, as shown in FIG. 12, at least part of the ink tank 26, more specifically, part of the ink container 26*a* overlaps at least part of the carriage 32 in the apparatus depth direction. Further, as shown in FIGS. 13 and 14, at least part of the carriage 32 overlaps at least part of the ink introducing section 26*b* of the ink tank 26 in the apparatus width direction while the carriage 32 is located at the home position in the movement area of the carriage 32. Further, as shown in FIG. 13, at least part of the sub base member 58 is located in the movement area of the carriage 32 in the apparatus width direction while the carriage 32 is located at the home position.

Maintenance Unit

As shown in FIGS. 10 and 17, the maintenance unit 60 includes, for example, a cap section 78 and a suction pump 80. The cap section 78 is located on the lower side of the recording head 44 of the carriage 32 in the apparatus height direction when the carriage 32 is located at the home position.

The cap section 78 includes a cap 78*a* that can switch between a capped state in which it caps the recording head 44 and a uncapped state in which it is separated from the recording head 44 while the carriage 32 is located at the home position. The cap section 78 is connected to the suction pump 80 via a waste ink tube 82, which is shown in FIG. 17. When the suction pump 80 is driven during the capped state in which the cap 78*a* caps the recording head 44, a negative pressure is applied to the cap 78*a* via the waste ink tube 82 which connect the cap section 78 and the suction pump 80. This negative pressure allows for suctioning of ink from the nozzles of the recording head 44, thereby eliminating clogging of the nozzles and air bubble contamination. Further, the waste ink generated in the cap section 78 is suctioned by the suction pump 80 via the waste ink tube 82.

Waste Liquid Tank

Referring now to FIG. 10, a waste liquid tank mounting section 84 is disposed in the sub base member 58 on the rear side of the maintenance unit 60 in the apparatus depth direction. The waste liquid tank 66 is attached to the waste liquid tank mounting section 84 in a manner to be removable from the rear side of the sub base member 58 in the apparatus depth direction. The waste liquid tank 66 is configured to store the waste liquid (waste ink) suctioned in the cap section 78 while it is attached to the waste liquid tank mounting section 84. Moreover, a flow path or the like between the maintenance unit 60 and the waste liquid tank 66 will be described later. Further, the attachment direction of the waste liquid tank 66 is not limited to the apparatus depth direction relative to the sub base member 58, and the waste liquid tank 66 may be configured to be attached to the sub base member 58 in the apparatus width direction.

First Container Holding Member

Next, with reference to FIGS. 15 to 17, the first container holding member 86 will be described. The first container holding member 86 extends in the apparatus depth direction. As shown in FIG. 16, the first container holding member 86 is attached to the sub base member 58 so as to cover at least part of the upper part of the waste liquid tank 66.

With reference to FIG. 15, the first container holding member 86 is provided with a buffer tank holding section 86*a* that holds the buffer tank 64 on the rear side in the apparatus depth direction. Further, a connection tube container 86*b* that extends forward in the apparatus depth direction is disposed in the first container holding member 86 on the front side of the buffer tank holding section 86*a* in the apparatus depth direction. Moreover, an ink supplying tube container 86*c* that extends leftward in the apparatus width direction is disposed on the front end of the connection tube container 86*b* in the apparatus depth direction.

As shown in FIGS. 11, 14 and 17, the connection tube container 86*b* and at least part of the ink supplying tube container 86*c* are located above the ink container 26*a* of the ink tank 26 in the apparatus height direction and covers the ink container 26*a* while the first container holding member 86 is attached to the sub base member 58.

Further, as shown in FIG. 11, the ink supplying tubes 42 connected to the connecting sections 26*e* of the ink container 26*a* of the ink tanks 26 are held by the ink supplying tube container 86*c* of the first container holding member 86 and guided to the left in the apparatus width direction and then connected to the relay adapters 40 (see FIG. 4) of the carriage 32.

Further, referring to FIG. 16, a plurality of buffer tanks 64A, 64B, 64C, 64D and 64E (hereinafter, comprehensively referred to as the buffer tank 64) is disposed in the buffer tank holding section 86*a* of the first container holding member 86. Note that, the same number of the buffer tanks 64 as the ink tanks 26 are provided. The buffer tanks 64A, 64B, 64C, 64D and 64E correspond to the ink tanks 26A, 26B, 26C, 26D and 26E, respectively. Specifically, the buffer tanks 64 are connected to second ends of the connection tubes 76, which are connected to the corresponding ink tanks 26. In this embodiment, the second ends of the two connection tubes 76, which are connected to the ink tank 26A are connected to the buffer tank 64A.

As an example, four buffer tanks 64E, 64D, 64C and 64B having the same volume are disposed on the right side in the apparatus width direction and arranged in sequence from the front to the rear side in the apparatus depth direction. Further, the buffer tank 64A having a volume larger than that of the four buffer tanks 64B, 64C, 64D and 64E is disposed on the left side in the apparatus width direction.

As shown in FIGS. 9 and 17, the second container holding member 88 is attached to the first container holding member 86 so as to cover the plurality of buffer tanks 64. The connection tubes 76 are led out from the buffer tanks 64 to the upper part of the second container holding member 88. Further, in the present embodiment, the plurality of buffer tanks 64 is located above the waste liquid tank 66 in the apparatus height direction. Further, at least part of the plurality of buffer tanks 64 overlaps at least part of the waste liquid tank 66 in at least one of the apparatus width direction and apparatus depth direction.

As shown in FIGS. 9 and 17, a first flow path holding section 90 as a "flow path holding section" is disposed on the upper side of the second container holding member 88. The first flow path holding section 90 prevents the connection tube 76 from being lifted upward in the apparatus height direction on the upper side of the second container holding member 88. Further, the first flow path holding section 90 bundles the connection tubes 76 led out from the respective buffer tanks 64 and guides the connection tubes 76 to the front side in the apparatus depth direction.

The connection tubes 76 extend downward in the apparatus height direction on the front end of the second container holding member 88 in the apparatus depth direction, and are received in the connection tube container 86*b* of the first container holding member 86. Further, the connection tubes 76 extend forward in the apparatus depth direction along the connection tube container 86*b*. Further, as shown in FIG. 11, the connection tubes 76 pass under the reinforcement member 72 and extend to the rear side of the ink introducing section 26*b* of the ink tanks 26 in the apparatus depth direction, and are then turned upward in the apparatus height direction to change the direction and connected to the upper part of the ink introducing section 26*b*. In the present embodiment, as an example, the height of a portion of the connection tubes 76 in the apparatus height direction (see FIG. 12) which extend along the connection tube container 86*b* in the front-back direction in the apparatus depth direction is set to be higher than the height of the recording head 44 in the apparatus height direction when a gap between the recording head 44 and the medium support member 46 becomes minimum.

The connection tube container 86*b* is provided with a second flow path holding section 92, which is a "flow path holding section." The second flow path holding section 92 holds at least part of the connection tubes 76 which extend in the apparatus depth direction in the connection tube container 86*b* and prevent the connection tubes 76 from being lifted in the apparatus height direction. In the present embodiment, the connection tubes 76 are configured as a multiple tube having a three-tube unit. With this configuration, when one of three connection tubes 76 in the three-tube unit is held in the second flow path holding section 92, the other two tubes are also held in the connection tube container 86*b*.

Relationship Between Ink Tank and Buffer Tank

Referring again to FIG. 12, the relationship between the ink tank 26 and the buffer tank 64 will be described. The buffer tanks 64 are each connected to the ink tank 26 via the connection tubes 76. When the ink introduction port 26*d* is closed by the ink introduction port cover 74, the pressure in the ink tank 26 increases, for example, according to an increase in the temperature surrounding the printer 10. This may cause ink in the ink tank 26 to be pushed into the buffer tank 64.

As an example, the ink storable amount of each buffer tank 64 is set to be substantially the same as the ink storing amount of the ink tank 26 connected by the connection tube 76, or more than that amount. Accordingly, even if the ink stored in the ink tank 26 flows into the buffer tank 64, ink leakage from the buffer tank 64 can be prevented or reduced. Further, the ink tank 26 communicates with atmosphere via the buffer tank 64.

Moreover, the dotted line denoted by reference character IL in FIG. 12 indicates the maximum height of the level of ink stored in the ink tank 26 in the apparatus height direction. As an example, a bottom 64*a* of the ink storage space in the buffer tank 64 is set to be at the height corresponding to the maximum height IL of the level of ink stored in the ink tank 26 in the apparatus height direction. Further, the height of the bottom 64*a* of the ink storage space in the buffer tank 64 is preferably set to be at the position higher than the maximum height IL in the apparatus height direction.

With this configuration, the pressure in the ink tank 26 decreases, for example, by rotating the ink introduction port cover 74 to open the ink introduction port 26*d* when ink has flowed into the buffer tank 64 due to increase in the pressure in the ink tank 26, or according to a decrease in the temperature surrounding the printer 10. As a result, ink in the buffer tank 64 is returned into the ink tank 26 via the connection tube 76.

Relationship Between Maintenance Unit and Waste Liquid Tank

Next, with reference to FIGS. 10, 16 and 17 to 22, the relationship between the maintenance unit 60 and the waste liquid tank 66 will be described. Referring to FIGS. 10 and 17, the maintenance unit 60 and the waste liquid tank mounting section 84 are connected to each other via a first waste liquid tube 94 and a second waste liquid tube 96, which are "waste liquid flow path members." Moreover, the first waste liquid tube 94 and the second waste liquid tube 96 are connected to each other via a joint member 98.

As shown in FIG. 17, a first end of the first waste liquid tube 94 is connected to the maintenance unit 60, more specifically, to the suction pump 80. Further, the first waste liquid tube 94, which extends from the suction pump 80, extends into the connection tube container 86*b* of the first container holding member 86 and is held by the second flow path holding section 92.

Referring now to FIG. 18, the first waste liquid tube 94 guided into the connection tube container 86*b* is located above the connection tube 76 in the apparatus height direction. Further, the first waste liquid tube 94 as an example extends in a circle around the second flow path holding section 92 in the clockwise direction in FIG. 18 and then extends in the apparatus depth direction. As shown in FIG. 17, a second end of the first waste liquid tube 94 is connected to the second waste liquid tube 96 via the joint member 98. In FIG. 18, the joint member 98 and the second waste liquid tube 96 are not shown in the figure.

Although the first waste liquid tube 94 in the present embodiment extends in a circle around the second flow path holding section 92, it may extend in the apparatus depth direction without extending around the second flow path holding section 92 or extend in two circles around the second flow path holding section 92 as appropriate depending on the length of the first waste liquid tube 94. That is, the second flow path holding section 92 serves not only to hold the first waste liquid tube 94 above the connection tube 76 so as not to be lifted above in the apparatus height direction, but also to adjust the length of the first waste liquid tube 94.

Next, as shown in FIG. 16, the joint member 98 is connected to a first end of the second waste liquid tube 96. The second waste liquid tube 96 exits the connection tube container 86*b*, extends downward in the apparatus height direction, and a second end of the second waste liquid tube 96 is connected to the waste liquid tank mounting section 84. As a result, the suction pump 80 of the maintenance unit 60 is connected to the waste liquid tank 66 via the first waste liquid tube 94, the joint member 98, the second waste liquid tube 96 and the waste liquid tank mounting section 84 when the waste liquid tank 66 is attached to the waste liquid tank mounting section 84. Accordingly, waste liquid (waste ink) suctioned by the suction pump 80 is fed into the waste liquid tank 66 and stored in the waste liquid tank 66.

Configuration of Waste Liquid Tank and Waste Liquid Tank Mounting Section

Next, with reference to FIGS. 19 to 22, the configuration of the waste liquid tank 66 and the waste liquid tank mounting section 84 will be described. As shown in FIGS. 19 and 20, the waste liquid tank mounting section 84 includes a contact terminal 100, a connecting connector 102, and a biasing section 104. The connecting connector 102 is connected to the second waste liquid tube 96. Further, the biasing section 104 as an example is provided as a plate spring member that extends in the apparatus depth direction.

Further, with reference to FIG. 21, the waste liquid tank 66 as an example is formed in a cuboid shape extending in the apparatus depth direction. Further, a connected connector 66*a* configured to be connected to the connecting connector 102 is disposed on the front end in the apparatus depth direction. In addition, a storage medium 66*b* is disposed on the side surface on the front end in the apparatus depth direction. The storage medium 66*b* is configured to store information such as the waste ink storing among of the waste liquid tank 66. Moreover, an engagement section 66*c* is disposed on the same side in the apparatus width direction as that on which the storage medium 66*b* is provided.

As shown in FIG. 19, when the waste liquid tank 66 is inserted into the sub base member 58 from the rear side in the apparatus depth direction, the engagement section 66*c* of the waste liquid tank 66 engages with the biasing section 104 of the waste liquid tank mounting section 84. The waste liquid tank 66 is kept to be held by the sub base member 58 by a biasing force of the biasing section 104. When the engagement section 66*c* engages with the biasing section 104, the connected connector 66*a* of the waste liquid tank 66 is connected to the connecting connector 102 of the waste liquid tank mounting section 84. Accordingly, the waste ink storage space in the waste liquid tank 66 communicates with the second waste liquid tube 96, allowing for transportation of the waste liquid (waste ink) suctioned by the suction pump 80 of the maintenance unit 60 to the waste liquid tank 66.

Further, when the engagement section 66*c* of the waste liquid tank 66 engages with the biasing section 104 of the waste liquid tank mounting section 84, the storage medium 66*b* of the waste liquid tank 66 is in contact with the terminal 100 to thereby establish electrical connection between the storage medium 66*b* and the contact terminal 100.

As shown in FIG. 22, the contact terminal 100 is connected to a first end of the cable 106. The cable 106 as an example is provided as a flexible flat cable (FFC). The cable 106 extending from the contact terminal 100 of the waste liquid tank mounting section 84 is held by a wiring holding section 86*d* disposed between the buffer tank holding section 86*a* and the connection tube container 86*b* in the first container holding member 86 and extends upward in the apparatus height direction.

The cable 106 turns to change the direction of the cable 106 to the front side in the apparatus depth direction on the upper side of the wiring holding section 86*d,* and extends forward in the apparatus depth direction along the side surface of the connection tube container 86*b* of the first container holding member 86. Then, as shown in FIG. 17, the cable 106 extends in the apparatus depth direction to the rear side of the ink container 26*a* of the ink tank 26 in the apparatus depth direction, and then turns left in the apparatus width direction and connected to a control section, which is not shown in the figure.

The control section, which is not shown, is disposed in the apparatus main body 12 of the printer 10. The control section is configured as a circuit substrate having a plurality of electric components and controls operations of the printer 10. Accordingly, when the storage medium 66*b* of the waste liquid tank 66 is electrically connected to the contact terminal 100, the information stored in the storage medium 66*b* of the waste liquid tank 66 is transmitted to the control section, which is not shown, disposed in the apparatus main body 12.

Positional Relationship Among Carriage, Buffer Tank and Waste Liquid Tank

Further, with reference to FIGS. 23 and 24, positional relationship between the carriage 32, the buffer tank 64 and the waste liquid tank 66 will be described. In FIG. 23, when the carriage 32 is located at the home position in the movement area of the carriage 32, at least part of the carriage 32 overlaps at least part of the waste liquid tank 66 in the apparatus width direction. Further, at least part of the carriage 32 overlaps at least part of the buffer tank 64 in the apparatus width direction.

Further, with reference to FIG. 24, at least part of the carriage 32 overlaps at least part of the buffer tank 64 in the apparatus height direction. The waste liquid tank 66 is disposed under the underside of the recording head 44 of the carriage 32.

Inlet

Next, with reference to FIGS. 19 and 25 to 27, the inlet 108 will be described. As shown in FIG. 19, the inlet 108 is disposed in the inlet housing section 58*d,* which is disposed on the side end of the sub base member 58 in the apparatus depth direction and on the right side in the apparatus width direction, that is, on the outermost side.

As shown in FIG. 25, the inlet 108 is configured to be connected to a power supply cable 110 (see FIGS. 6 and 8) that supplies electric power from an external power supply (not shown in the figure) to the inside of the apparatus main body 12. The electric cable 112 extending from the inlet 108 extends to the front side in the apparatus depth direction and is connected to the power supply section 20 disposed on the rear side of the operation section 16. The power supply cable 110 supplies electric power from the external power to the power supply section 20 via the inlet 108 and the electric cable 112. An end of the cable 112 which is connected to the power supply section 20 is configured as a connector and is configured to be easily detachably attached to the power supply section 20.

As shown in FIGS. 26 and 27, a wall 58*e* extends upward in the apparatus height direction in the inlet housing section 58*d* so as to separate between the inlet 108 and the waste liquid tank 66 in the apparatus width direction. The wall 58*e* extends in the apparatus depth direction between the inlet 108 and the waste liquid tank 66 in the apparatus width direction. Further, a wall 58*f* which extends to the right in the apparatus width direction is formed on the front end of the wall 58*e* in the apparatus depth direction.

That is, as shown in FIG. 26, the inlet housing section 58*d* is formed in the sub base member 58 in a box shape which is open upward in the apparatus height direction. Further, as shown in FIG. 27, the buffer tank holding section 86*a* of the first container holding member 86 and the buffer tank 64 are disposed above the inlet housing section 58*d* in the apparatus height direction.

Accordingly, the buffer tank holding section 86*a* covers the upper side of the inlet housing section 58*d* in the apparatus height direction. As a result, for example, even if ink leaks from the ink tank 26, the maintenance unit 60, the waste liquid tank 66 or the like in the ink supply unit 52, the wall 58*e,* the wall 58*f* and the buffer tank holding section 86*a* prevent ink from entering the inlet housing section 58*d*. Further, although the upper part of the inlet housing section 58*d* is covered by the buffer tank holding section 86*a* in the present embodiment, it may be covered by other member than the first container holding member 86.

Modified Embodiments (1) In the present embodiment, the first flow path holding section 90 is disposed on the second container holding member 88 that covers the upper part of the buffer tank 64. However, the first flow path holding section 90 may be provided on the upper part of the buffer tank 64 to hold the connection tube 76 while the buffer tank 64 is not covered by the second container holding member 88.

(2) In the present embodiment, the wiring holding section 86*d* that holds the cable 106 is provided on the first container holding member 86. However, instead of this configuration, the buffer tank 64 and the like may be configured to hold the cable 106.

(3) In the present embodiment, the maintenance unit 60 is provided on the recording unit 50. However, instead of this configuration, the maintenance unit 60 may be provided on the ink supply unit 52.

(4) In the present embodiment, the ink supply unit 52 is provided on the right side of the recording unit 50 in the apparatus width direction. However, instead of this configuration, the ink supply unit 52 may be provided on the left side of the recording unit 50 in the apparatus width direction.

(5) Further, in the present embodiment, the ink tank section 24 is provided on the front side of the sub base member 58 in the apparatus depth direction and a plurality of ink tanks 26 of a large volume are disposed to supplement ink from the ink introduction port 26*d*. However, instead of this configuration, a plurality of ink cartridges 114 may be provided as shown in FIG. 28 in the region in which the ink tank section 24 is provided so as to be removably attached to the ink supply unit 52, as an example, from the front side in the apparatus depth direction.

(6) Further, in the present embodiment, the buffer tanks 64A, 64B, 64C, 64D and 64E are arranged in two lines in the apparatus width direction in the buffer tank holding section 86*a* of the first container holding member 86. However, instead of this configuration, the buffer tanks 64 may be arranged in one line in the apparatus width direction as shown in FIGS. 29 and 30. Specifically, as shown in FIG. 30, only the buffer tank holding section 116*a* is provided in the first container holding member 116 without providing the connection tube container. Further, as an example, the buffer tanks 64 may be arranged in sequence with the buffer tank 64A being located on the rearmost side in the apparatus depth direction.

(7) Further, in the present embodiment, the first container holding member 86 and the buffer tank 64 are disposed on the rear side of the ink tank section 24 in the apparatus depth direction. However, instead of this configuration, the first container holding member 86 and the buffer tank 64 may be arranged in the apparatus width direction as shown in FIGS. 31 and 32 at a position where the power supply section 20 is provided in the present embodiment, that is, on the rear side of the operation section 16 in the apparatus depth direction. In this case, a plurality of buffer tanks 64 are arranged in sequence in the apparatus width direction.

To summarize the above description, the printer 10 includes: the recording head 44 having a nozzle that is configured to eject liquid; the ink tank 26 that is configured to receive the liquid ejected from the nozzle, and is disposed at a separate position from the recording head 44; the waste liquid tank 66 that stores waste ink ejected from the recording head 44; the main base member 56 which includes at least the recording head 44 and constitutes a base of the apparatus; and the sub base member 58 which includes at least one of the ink tank 26 and the waste liquid tank 66 and is detachably attached to the main base member 56, and constitutes a base of the apparatus main body 12 together with the main base member 56.

According to the above configuration, the base of the apparatus main body 12 is composed of the main base member 56 and the sub base member 58 that is detachably attached to the main base member 56, and the sub base member 58 includes at least one of the ink tank 26 and the waste liquid tank 66. As a result, the apparatus design can be changed only by changing the sub base member 58 without changing the main base member 56, thereby enabling at least either of shortening of the development period or reduction in the cost in changing the apparatus design.

The printer 10 includes the buffer tank 64 that is connected to the ink tank 26 and stores ink discharged from the ink tank 26, wherein the ink tank 26, the waste liquid tank 66, and the buffer tank 64 are provided in the sub base member 58. According to the above configuration, at least either of shortening of the development period or reduction in the cost can be achieved in changing the design of at least one of the ink tank 26, the waste liquid tank 66 and the buffer tank 64.

The sub base member 58 is detachably attached to at least one side of the main base member 56.

The sub base member 58 includes: the ink supplying tube 42 that is connected to the ink tank 26 and guides liquid from the ink tank 26 toward the recording head 44; the first waste liquid tube 94 and the second waste liquid tube 96 that are connected to the waste liquid tank 66 and guides the waste ink to the waste liquid tank 66; the connection tube 76 that is connected to the buffer tank 64 and guides the ink discharged from the ink tank 26 to the buffer tank 64, wherein the sub base member 58 includes at least one of the ink supplying tube container 86*c* that holds the ink supplying tube 42, the first flow path holding section 90 that holds the connection tube 76, and the second flow path holding section 92 that holds the first waste liquid tube 94, the second waste liquid tube 96 and the connection tube 76.

According to the above configuration, components associated with ink are closely positioned compared with the configuration in which the ink supplying tube 42, the first waste liquid tube 94 and the second waste liquid tube 96, and the connection tube 76 are provided to the dedicated setting members at separate positions, thereby preventing the apparatus from increasing in size or facilitating assembly of the apparatus.

The printer 10 includes: the maintenance unit 60 that performs maintenance of the recording head 44, wherein the maintenance unit 60 is disposed in the sub base member 58. According to the above configuration, components associated with ink are closely positioned compared with the configuration in which the maintenance unit 60 is provided to the dedicated setting members at a separate position, thereby preventing the apparatus from increasing in size or facilitating assembly of the apparatus.

At least part of the sub base member 58 is located in a movement area of the recording head 44, that is, the carriage 32 in the movement direction of the recording head 44. According to the above configuration, the apparatus size in the apparatus width direction, which is the movement direction of the recording head 44 can be reduced.

The recording head 44 is disposed on the carriage 32 that is movable in an apparatus width direction, and the liquid tank 26 is disposed on one end of the movement area of the carriage 32, and includes: the ink container 26*a;* and the ink introducing section 26*b* that is disposed on the ink container 26*a* and has a projected area in a planar direction which is smaller than the projected area of the ink container 26*a,* wherein when the carriage 32 is located on one end of the movement area, that is, the home position, at least part of the ink container 26*a* overlaps at least part of the carriage 32 in the apparatus depth direction, and at least part of the ink introducing section 26*b* overlaps at least part of the carriage 32 in the apparatus width direction.

According to the above configuration, when the carriage 32 is located on the home position, which is one end of the movement area, at least part of the ink container 26*a* overlaps at least part of the carriage 32 in the apparatus depth direction. Accordingly, the size in the apparatus depth direction can be reduced. Further, at least part of the ink introducing section 26*b* overlaps at least part of the carriage 32 in the apparatus width direction. Accordingly, the size in the apparatus width direction can be reduced.

The ink container 26*a* has at least two surfaces of peripheral surfaces that is covered by the wall 58*c* of the sub base member 58, and a top surface that is reinforced by the reinforcement member 72. According to this configuration, the strength of the ink container 26*a* can be improved.

The ink supplying tube 42 extends upward from the connecting section 26*e* of the ink tank 26, and is then bent into the movement direction of the recording head 44, that is, the carriage 32, and a portion of the ink supplying tube 42 which extends upward is located in the movement area of the carriage 32 having the recording head 44 in the movement direction of the recording head 44. According to this configuration, the apparatus size in the movement direction of the recording head 44 can be reduced.

Further, in the present embodiment, the recording unit 50 and the ink supply unit 52 according to the present invention are applied to an ink jet printer which is an example of a liquid ejecting apparatus. However, they can also be applied to other liquid ejecting apparatuses in general. The liquid ejecting apparatus herein is not limited to a recording apparatus such as a printer, copy machine and facsimile machine that uses an ink jet recording head and performs recording onto a recording medium by ejecting ink from the recording head, but also includes an apparatus that causes various liquid depending on the application instead of ink to be ejected from a liquid ejecting head, which corresponds to the ink jet recording head, onto an ejection target medium, which corresponds to the recording medium, to thereby allow the liquid to be adhered onto the ejection target medium.

In addition to the aforementioned recording heads, the liquid ejecting head includes color material ejection heads used for manufacturing color filters for liquid crystal displays and the like, electrode material (electrically conductive paste) ejection heads used for manufacturing electrodes for organic EL displays, field emission displays (FEDs) and the like, bioorganic ejection heads used for manufacturing biochips, and sample ejection heads which are micropipettes.

It should be noted that the present invention is not limited to the above embodiments. Regardless to say, various modifications are contemplated within the scope of the invention as defined in the appended claims, and these should be included in the scope of the present invention.

The entire disclosure of Japanese Patent Application No. 2016-210308, filed Oct. 27, 2016 is expressly incorporated by reference herein.

What is claimed is:

1. A liquid ejecting apparatus comprising:

a liquid ejecting section having a nozzle that is configured to eject liquid, the liquid ejecting section being configured to move along a path in a movement direction;

a liquid tank that is configured to deliver to the liquid ejecting section the liquid ejected from the nozzle, and is disposed at a separate position from the liquid ejecting section;

a waste liquid containing chamber that stores a waste liquid generated during a maintenance operation of the liquid ejecting section, wherein the waste liquid containing chamber is separate from the liquid tank and is configured to be removed and replaced independently from the liquid tank;

a main base section which includes at least the liquid ejecting section and constitutes a bottom surface of the apparatus; and a sub base section that is configured to be directly attached to the main base section and detached from the main base section, wherein the sub base section includes the liquid tank and the waste liquid containing chamber, and constitutes a bottom surface of the apparatus together with the main base section, the liquid tank and the waste liquid containing chamber being statically disposed on opposite sides of the path, wherein the sub base section is configured such that the waste liquid containing chamber is removable through a rear side of the liquid ejecting apparatus in a depth direction.

2. The liquid ejecting apparatus according to claim 1, further comprising:

a fluid containing chamber that is connected to the liquid tank and stores liquid discharged from the liquid tank, wherein the liquid tank, the waste liquid containing chamber and the fluid containing chamber are provided in the sub base section.

3. The liquid ejecting apparatus according to claim 2, wherein the sub base section is detachably attached to at least one side of the main base section.

4. The liquid ejecting apparatus according to claim 2, further comprising:

a liquid supply path member that is connected to the liquid tank and guides liquid from the liquid tank toward the liquid ejecting section;

a waste liquid flow path member that is connected to the waste liquid containing chamber and guides the waste liquid to the waste liquid containing chamber; and a connection flow path member that is connected to the fluid containing chamber and guides liquid discharged from the liquid tank to the fluid containing chamber, wherein the sub base section includes a flow path holding section that includes at least one of the liquid supply path member, the waste liquid flow path member and the connection flow path member.

5. The liquid ejecting apparatus according to claim 1, further comprising a maintenance unit that performs maintenance of the liquid ejecting section, wherein the maintenance unit is disposed in the sub base section.

6. The liquid ejecting apparatus according to claim 1, wherein at least part of the sub base section is located in a movement area of the liquid ejecting section in a movement direction of the liquid ejecting section.

7. The liquid ejecting apparatus according to claim 1, wherein the liquid ejecting section is disposed on a carriage that is movable in an apparatus width direction, and the liquid tank is disposed on one end of a movement area of the carriage, and includes:

a first structure; and a second structure that is disposed on the first structure and has a projected area in a planar direction which is smaller than the projected area of the first structure, wherein when the carriage is located on one end of the movement area, at least part of the first structure overlaps at least part of the carriage in the apparatus depth direction, and at least part of the second structure overlaps at least part of the carriage in the apparatus width direction when viewed in the depth direction.

8. The liquid ejecting apparatus according to claim 7, wherein the first structure has at least two surfaces of peripheral surfaces that is covered by a wall of the sub base section, and a top surface that is reinforced by a reinforcement member.

9. The liquid ejecting apparatus according to claim 4, wherein the liquid supply path member extends upward from a connecting section of the liquid tank, and is then bent into a movement direction of the liquid ejecting section, and a portion of the liquid supply path member which extends upward is located in a movement area of the carriage having the liquid ejecting section in the movement direction of the liquid ejecting section.

* * * * *